US011123651B2

(12) United States Patent
Wong et al.

(10) Patent No.: US 11,123,651 B2
(45) Date of Patent: Sep. 21, 2021

(54) BUILDING BLOCKS AND BUILDING BLOCK ASSEMBLIES

(71) Applicant: LOBO BLOCKS LIMITED, Hong Kong (HK)

(72) Inventors: Yeung Wong, Hong Kong (HK); Tang Chan, Hong Kong (HK)

(73) Assignee: LOBO BLOCKS LIMITED, Hong Kong (HK)

( * ) Notice: Subject to any disclaimer, the term of this patent is extended or adjusted under 35 U.S.C. 154(b) by 0 days.

(21) Appl. No.: 16/337,462

(22) PCT Filed: Sep. 28, 2017

(86) PCT No.: PCT/IB2017/055950

§ 371 (c)(1),
(2) Date: Mar. 28, 2019

(87) PCT Pub. No.: WO2018/060911

PCT Pub. Date: Apr. 5, 2018

(65) Prior Publication Data

US 2019/0232186 A1 Aug. 1, 2019

(30) Foreign Application Priority Data

Sep. 28, 2016 (HK) ..... 16111366.5

(51) Int. Cl.
*A63H 33/08* (2006.01)
*A63H 33/06* (2006.01)
*A63H 17/26* (2006.01)

(52) U.S. Cl.
CPC ..... *A63H 33/086* (2013.01); *A63H 17/262* (2013.01); *A63H 33/062* (2013.01)

(58) Field of Classification Search
CPC ... A63H 33/042; A63H 33/062; A63H 33/086
(Continued)

(56) References Cited

U.S. PATENT DOCUMENTS 3,492,756 A * 2/1970 Stubbmann ..... A63H 33/04 446/85
4,606,732 A * 8/1986 Lyman ..... A63H 33/086 446/104

(Continued)

FOREIGN PATENT DOCUMENTS

CN 2930815 Y 8/2007
CN 104338328 A 2/2015

(Continued)

OTHER PUBLICATIONS

International Search Report for PCT Patent Application No. PCT/IB2017/055950 dated Feb. 5, 2018.

*Primary Examiner* — Joseph B Baldori

(57) ABSTRACT

A building block assembly (50) comprises a first module (50A) and a second module (50B) which are in detachable engagement, wherein the first module (50A) and the second module (50B) are mechanically connected and relatively rotatable about a rotation axis. The first module (50A) is a building block module comprising a first building block and a second building block which are snap fastened or press fastened to form a building block stack. The second module (50B) is mechanically retained by the first module (50A) in a retention state upon snap fastening of the first building block and the second building block in a connection direction defined by a connection axis which is coaxial with the rotation axis to form the building block stack.

20 Claims, 9 Drawing Sheets

Figure 1B:
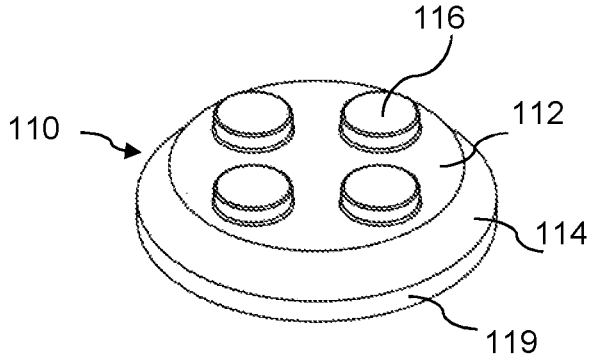

(58) Field of Classification Search
USPC ..... 446/93, 95, 102, 103, 120
See application file for complete search history.

(56) References Cited

U.S. PATENT DOCUMENTS

| | | | | | |
|---|---|---|---|---|---|
| 4,693,696 | A * | 9/1987 | Buck | A63H 17/262 | 152/379.3 |
| 5,527,201 | A | 6/1996 | Maddock | | |
| 5,853,314 | A * | 12/1998 | Bora | A63H 33/08 | 446/120 |
| 5,902,018 | A * | 5/1999 | Owen | B60B 37/10 | 301/111.03 |
| 8,888,552 | B2 * | 11/2014 | Wizenberg | A63H 33/086 | 446/102 |
| 9,259,968 | B2 * | 2/2016 | Tracey | B60B 33/0063 | |
| 2013/0181502 | A1 * | 7/2013 | Tracey | B60B 33/0063 | 301/1 |
| 2014/0011422 | A1 | 1/2014 | Channin | | |

FOREIGN PATENT DOCUMENTS

| | | | |
|---|---|---|---|
| CN | 204601632 | U | 9/2015 |
| CN | 205589722 | U | 9/2016 |

* cited by examiner

10
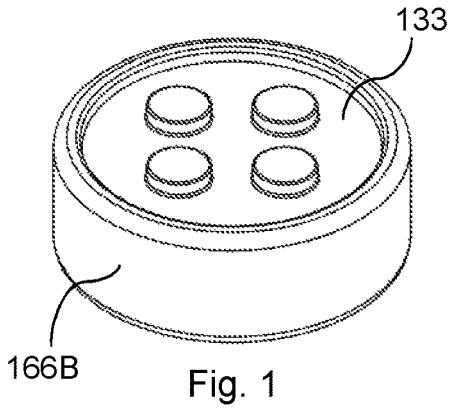
Fig. 1
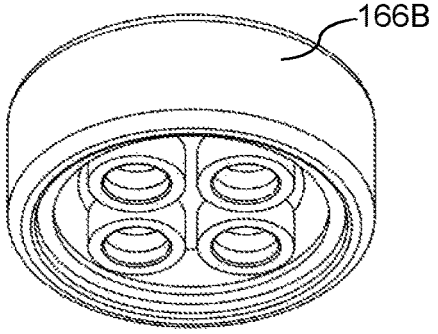
Fig. 1A2
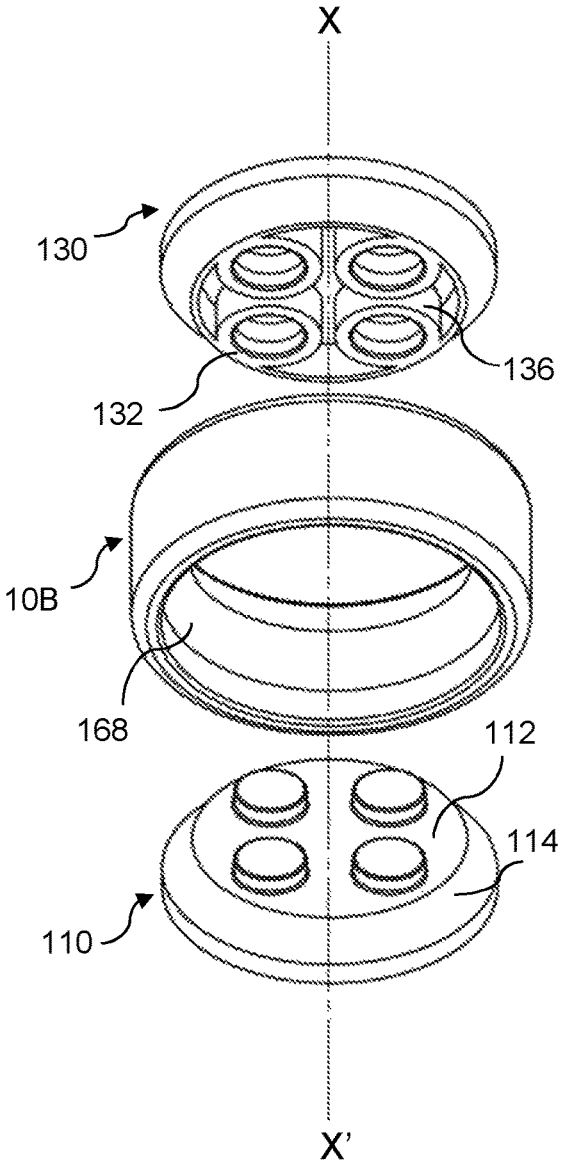
Fig. 1A1
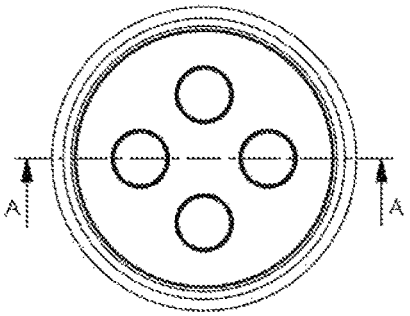
Fig. 1A3
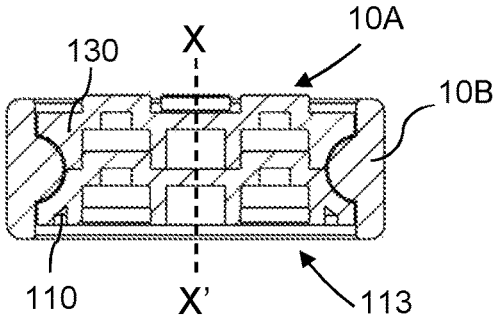
Fig. 1A4

20
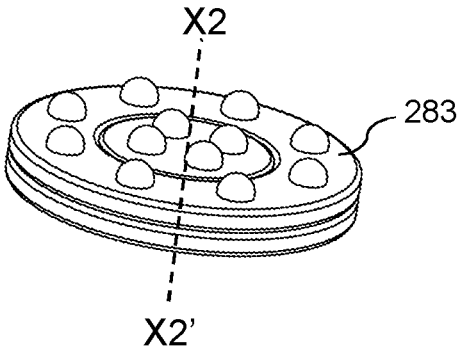
Fig. 2
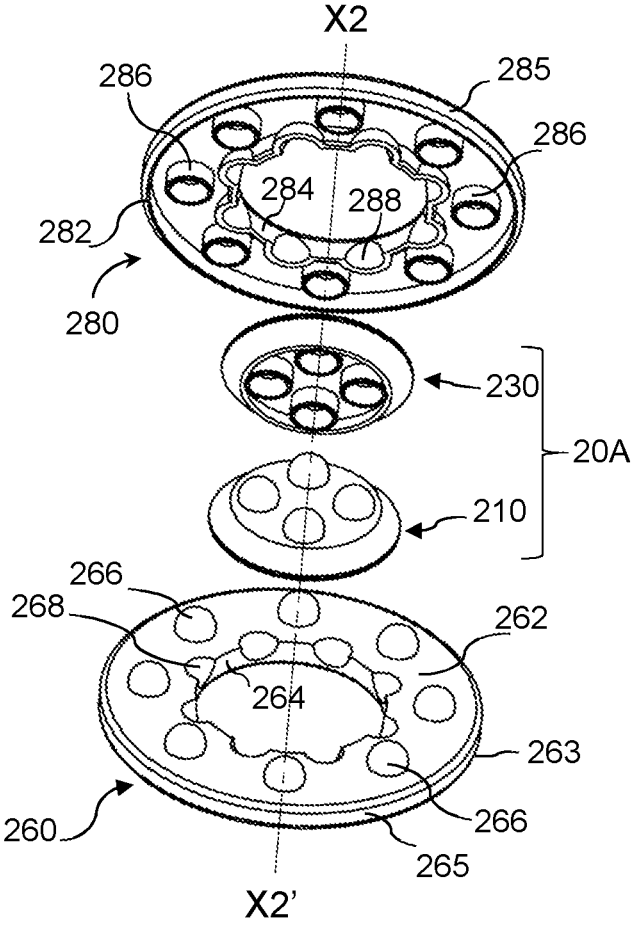
Fig. 2A1
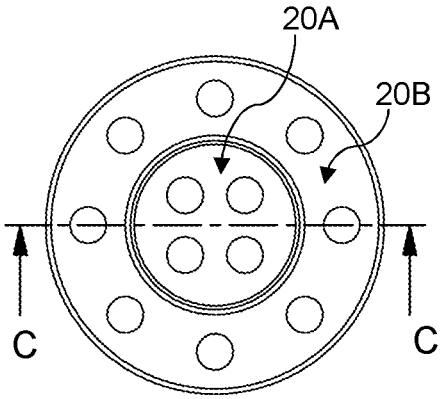
Fig. 2A2
20A
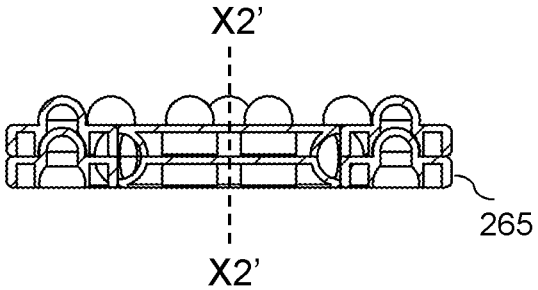
Fig. 2A3
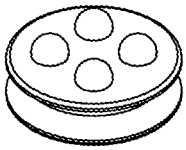
Fig. 2B
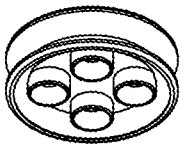
Fig. 2B1
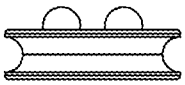
Fig. 2B2

20B
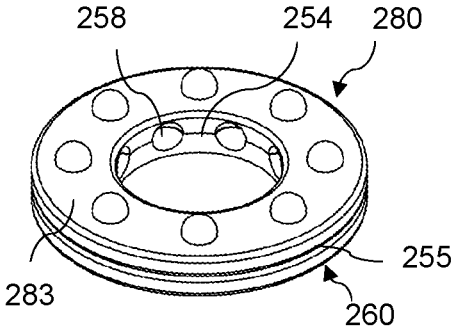
Fig. 2C
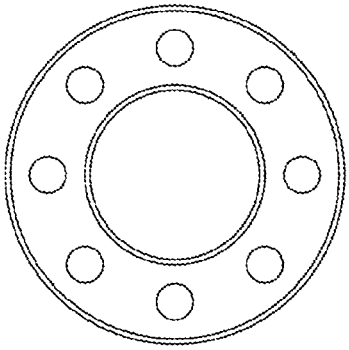
Fig. 2C2
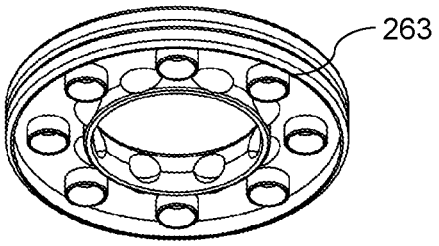
Fig. 2C1
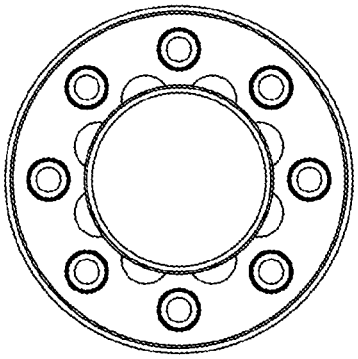
Fig. 2C3
280
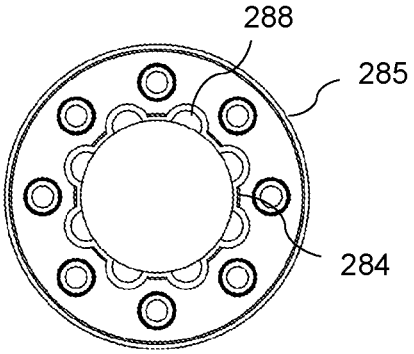
Fig. 2D1
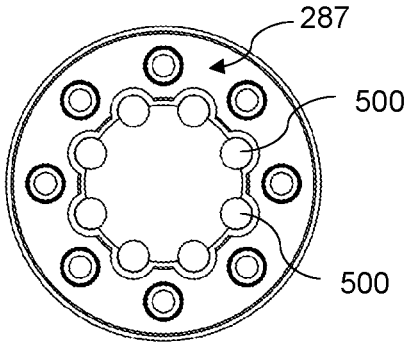
Fig. 2D2

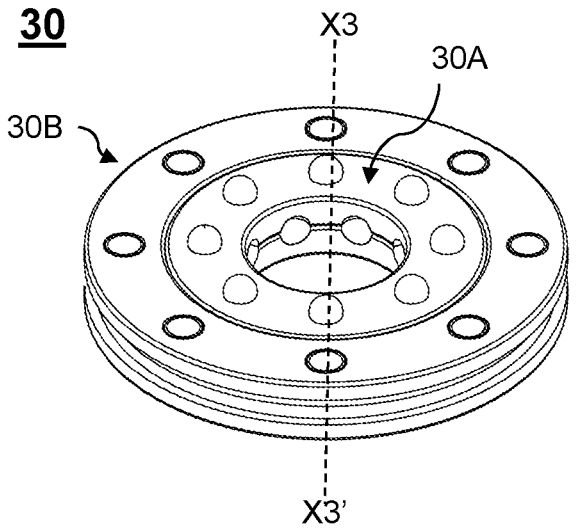
Fig. 3
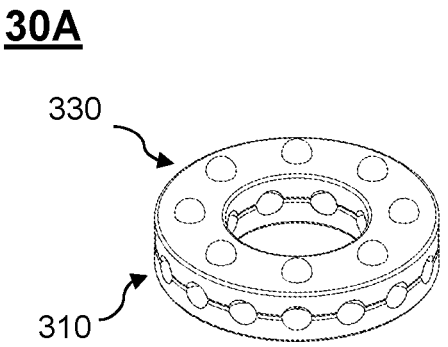
Fig. 3A
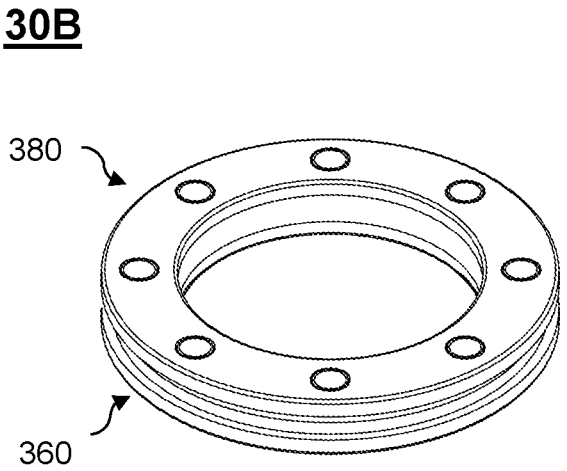
Fig. 3B
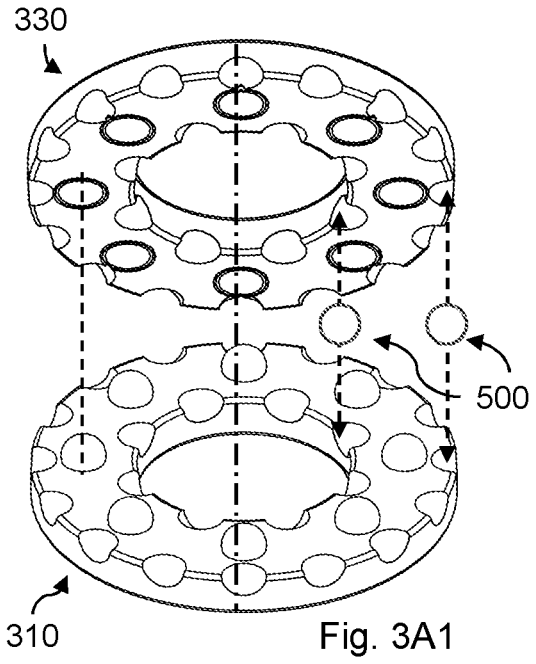
Fig. 3A1

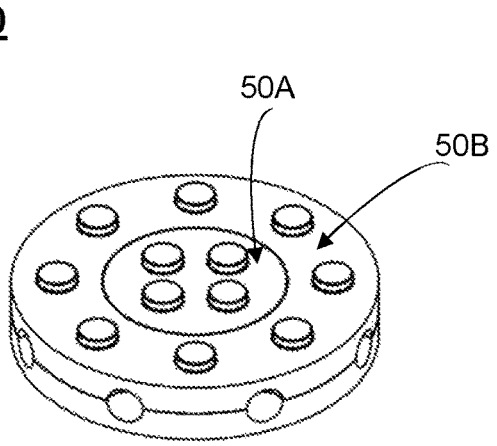
Fig. 5
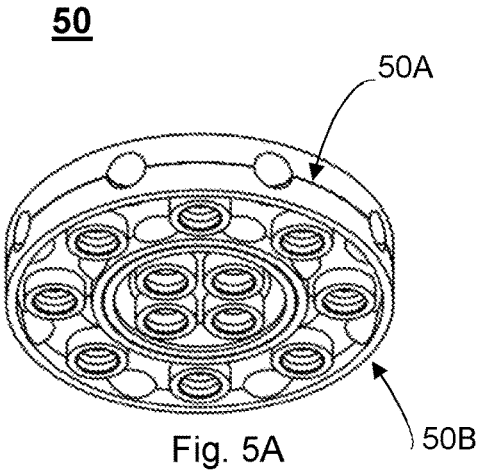
Fig. 5A
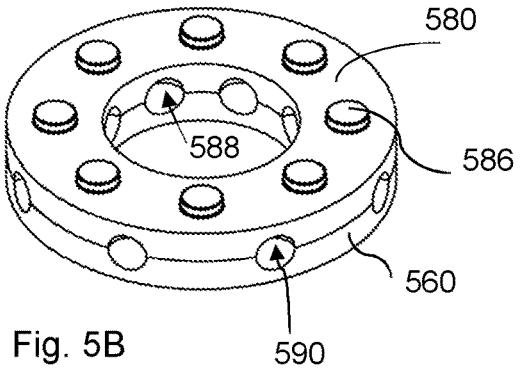
Fig. 5B
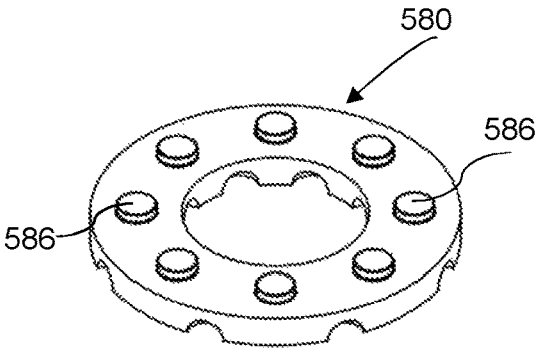
Fig. 5C1
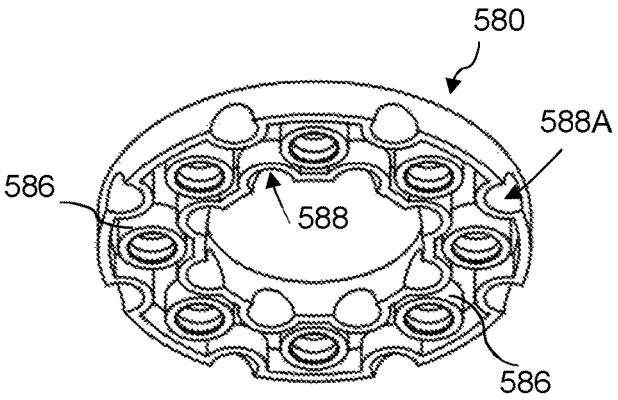
Fig. 5C2
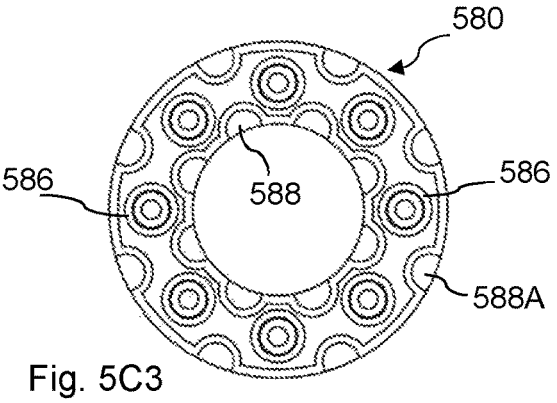
Fig. 5C3

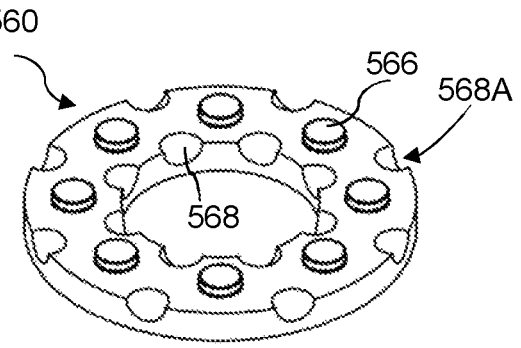
Fig. 5D1
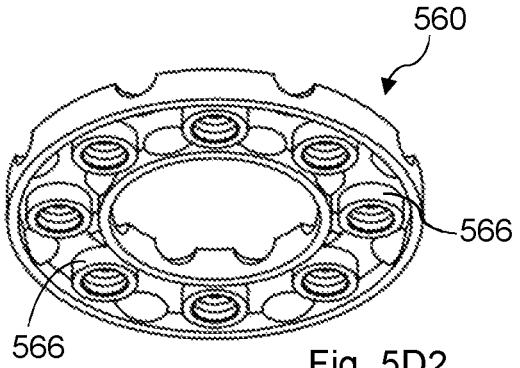
Fig. 5D2
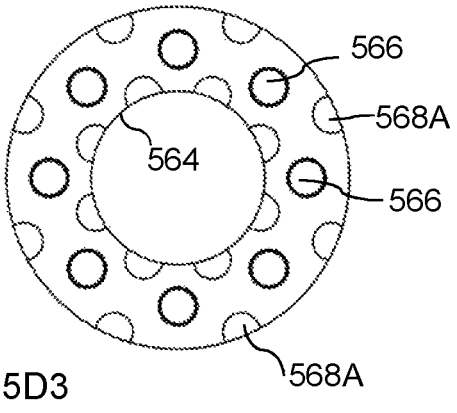
Fig. 5D3

BUILDING BLOCKS AND BUILDING BLOCK ASSEMBLIES

FIELD

The present disclosure relates to building blocks and building block assemblies.

BACKGROUND

Modular and interconnectible building blocks for construction of toys, such as toy figures, toy vehicles, toy houses, toy farms, toy machines, toy models, and other toy assemblies, toy products and toy structures are known and have been recognized for their educational values, for example, in promoting and encouraging creativity, patience and perseverance. Modular and interconnectible toy building blocks are advantageous, for example, many different types of toy assemblies, toy products and toy structures can be built with a small number of well-designed building blocks of basic configurations and the building blocks can be re-used for building of other toy assemblies, toy products and toy structures. Modular and interconnectible building blocks are also used in building industries, for example, as modular components for construction of buildings and structures. Use of modular and interconnectible building blocks has been known to facilitate flexible, expeditious and standardized construction with less manual work requirements and promote productivity. In addition to application as toys and in the building industry, modular and interconnectible toy building blocks are also used for modular construction of tools, equipment, appliances, and many other types of products.

DISCLOSURE

Modular and inter-connectible building blocks and assemblies comprising modular and interconnectible are disclosed.

A building block assembly disclosed herein comprises a first module and a second module which are in detachable engagement. The first module and the second module are mechanically connected and are relatively rotatable about a rotation axis. The first module is a building block module comprising a first building block and a second building block which are snap fastened or press fastened to form a building block stack. The second module is mechanically retained by the first module in a retention state upon snap fastening of the first building block and the second building block in a connection direction defined by a connection axis which is coaxial with the rotation axis to form the building block stack.

In some embodiments, the first building block comprises a first main body having a first surface and a second surface which is facing away from the first surface A plurality of snap connectors is distributed on the first surface to form a first connection means and a first connection surface having a first connection direction The second building block comprises a second main body having a first surface and a second surface which is facing away from the first surface. A plurality of snap connectors is distributed on the second surface to form a second connection means and a second connection surface having a second connection direction. The first connection means and the second connection means are matched and compatible snap connection means in snap engagement.

In some embodiments, the first module comprises a first retention portion and the second module comprises a second retention portion. The first retention portion and the second retention portion cooperate to form a retention means, and the first retention portion and the second retention portion cooperate to restrain or resist relative movement between the first module and the second module in an axial direction of the rotation axis or to contain the relative movement within a tight tolerance while permitting relative rotation between the first module and the second module in a rotation direction defined by the rotation axis, and/or to maintain the first module and the second module in the retention state in which the first module and the second module are interlocked.

In some embodiments, the first retention portion has a first retention profile in a radial direction with respect to the rotation axis and the second retention portion has a second retention profile in the radial direction. The first retention profile and the second retention profile are complementary profiles which cooperate to restrain or resist relative movement between the first module and the second module in the axial direction or to contain the relative movement within a tight tolerance while permitting relative rotation between the first module and the second module in the rotation direction.

In some embodiments, the first retention portion comprises a peripherally extending channel or a peripherally extending rib, the channel or the rib extending along a radial plane in a peripheral direction to surround the rotation axis, the radial plane and the peripheral direction being orthogonal to the rotation axis.

In some embodiments, the channel has a characteristic indentation and the rib has a characteristic protrusion. The indentation and the rib has a substantially constant profile in the peripheral direction.

In some embodiments, the indentation has a tapering profile or a flaring profile in a radial direction with respect to the rotation axis, and the protrusion has a tapering profile or a flaring profile in the radial direction.

In some embodiments, the indentation or the protrusion has a rounded end in the axial direction.

In some embodiments, the first building block comprises a first partial retention portion and the second building block comprises a second partial retention portion. The first partial retention portion and the second partial retention portion are stacked in a stacking direction by a stacking axis to form the first retention portion, the stacking axis being aligned with the rotation axis.

In some embodiments, the partial retention is integrally formed on the building block and is formed of a low friction thermoplastic.

In some embodiments, the first building block and the second building block are joined on a joining plane which is orthogonal to the rotation axis, and first partial retention portion and the second partial retention portion are mirror symmetrical about the joining plane.

In some embodiments, the first retention portion and the second retention portion cooperate to form a rotation guide when the first module and the second module are in relative rotation about the rotation axis.

In some embodiments, the second module is a building block module comprising a first building block and a second building block which are snap fastened to form a building block stack. The first retention portion is detachable from the first building block module or the second retention portion is detachable from the second building block module.

In some embodiments, the first retention portion comprises a plurality of discrete parts.

In some embodiments, the discrete parts comprise a plurality of freely rotatable bearing balls.

A building block disclosed herein comprises a main body having a first surface on a first axial end on which a first connection means defining a first connection surface is formed, a second surface on a second axial end on which a second connection means defining a second connection surface is formed, the first axial end and the second axial end being opposite axial ends on a center axis of the main body, a peripheral portion interconnecting the first axial end and the second axial end and having a peripheral wall, and a partial peripheral retention portion formed and exposed on the peripheral wall. The partial peripheral retention portion comprises a first peripheral formation which is adapted to form a retention portion with a corresponding second peripheral formation of a corresponding partial peripheral retention portion of a corresponding building block when the first connection surface of the building block and a corresponding first connection surface of the corresponding building block are in press-fit connection or snap-fit connection.

In some embodiments, the peripheral formation is in the form of a peripherally extending protrusion or a peripherally extending indentation, the peripherally extending protrusion or the peripherally extending indentation extending along a circular path and being continuous or non-continuous;

In some embodiments, the peripherally extending indentation and the peripherally extending protrusion has a radial retention profile, the radial retention profile being uniform.

In some embodiments, the peripherally extending protrusion includes a plurality of ball receptacles and a corresponding plurality of freely rotatable bearing balls. The ball receptacle is shaped to receive a bearing ball with a minor portion of the bearing ball protruding out of the peripheral wall.

In some embodiments, the main body includes a through cylindrical bore extending between the first axial end and the second axial end, the cylindrical bore being coaxial with the center axis. The peripheral portion includes an inner peripheral wall defining boundary of the through bore and the partial peripheral retention portion or the peripheral formation is formed on the inner peripheral wall.

A building block module disclosed herein has a first surface on a first axial end of a center axis of the module, a second surface on a second axial end opposite to the first axial end, a peripheral portion interconnecting the first axial end and the second axial end and having a peripheral wall, and a peripheral retention portion formed and exposed on the peripheral wall. The module comprises a first building block and a second building block and each of the first building block and the second building block has a first connection surface on which a first connection means is formed. The first connection means on the first building block and the first connection means on the second building block are matched and compatible connection means which are in press-fit engagement or snap-fit engagement. The peripheral retention portion is formed by stacked connection of the first building block and the second building block with center axes aligned.

A building block herein comprises one or a plurality of connectors to facilitate detachable or releasable mechanical connection between modular building blocks in abutment. The mechanical connection is typically by press-fitting or snap-fitting. The building block comprises one connector or a plurality of connectors on at least one connection surface and building blocks can be stacked with their respective connection surfaces in abutment connect and the connectors on their respective connection surfaces in detachable mechanical engagement.

A building block herein may be a toy building block. A toy building block is typically made of thermoplastics such as ABS (acrylonitrile butadiene styrene), PC (polycarbonate), or other plastic materials that a high degree of strength and rigidity, as well as a small degree of resilience to be slightly resiliently deformable to facilitate press-fit or snap-fit engagement.

A building block herein may be made of clay, ceramic, porcelain, concrete, or other mouldable materials that have a high rigidity and a very low degree of resilience or virtually no resilience.

A building block herein may also be made of wood, metals, for example, steel, aluminum, aluminum alloys, or other materials that can be shaped.

Where a building block is made of a material having a high rigidity with a very low degree of resilience or no resilience, the building block may connect with a building block having a sufficient degree of resilience to facilitate mechanical connection by resilient deformation of the connector(s) thereon.

In general, a building block can be rigid and slightly resilient or non-resilient, and the rigidity and resilience may be selected to suit applications by selecting appropriate materials or appropriate mix of materials.

A building block herein may be ceramic building block or a porcelain building block. The ceramic or porcelain building block may be in the form of a ceramic brick or a porcelain brick, a ceramic tile or a porcelain tile, a ceramic panel or a porcelain panel, or other forms of ceramic parts or porcelain parts without loss of generality. The ceramic or porcelain building blocks may be interconnected using binding agents such as glue, cement, or mortar to form the modules, assemblies or sub-assemblies, or interconnect with building blocks made of a rigid and slightly resilient material.

A building block herein typically comprises a main body, a first surface on a first side of the main body, a second surface on a second side of the main body, a peripheral portion extending between the first surface and the second surface, and a plurality of connectors formed on the main body. The main body is typically rigid or semi-rigid and the connectors have peripheral walls which are rigid or semi-rigid and having a small degree of resilience to facilitate snap engagement with corresponding connector through resilient deformation of the engagement portions of the connectors. The connectors are usually formed on a panel portion of the main body. In some embodiments, male connectors are formed on one panel portion and female connectors are formed on another panel portion separate from the panel portion on which the male connectors are formed. In some embodiments, male connectors and female connectors are formed on a common panel portion.

A connector herein means a building block connector unless the context requires otherwise. A building block connector comprises a connection portion having a coupling axis defining a coupling direction. The connection portion comprises an engagement portion for making closely fitted engagement with a matched connector portion of a matched connector to form a pair of engaged connectors.

An engagement portion comprises mechanical mating features for making closely fitted engagement with a corresponding engagement portion of a matched connector to form a pair of engaged engagement portions. An engagement portion may be a male engagement portion or a female engagement portion.

A connector is generally classified as a male connector or a female connector. However, a male connector may comprise a female engagement portion in addition to its inherent male engagement portion and a female connector may comprise a male engagement portion in addition to its inherent female engagement portion.

A male engagement portion comprises male mating features. A male engagement portion typically comprises a protrusion which is shaped and sized for closely-fitted reception of a corresponding female engagement portion. A protrusion adapted for closely-fitted reception of a corresponding female engagement portion is a matched corresponding male engagement portion of that corresponding female engagement portion. A protrusion herein is also referred to as a "protrusion portion", a "protruding member", a "protrusion member", "protrusion body", and "protruding body" and the terms are interchangeably used herein unless the context requires otherwise.

A female engagement portion comprises female mating features. A female engagement portion typically comprises a coupling receptacle which is shaped and sized for closely-fitted reception of a corresponding male engagement portion. A coupling receptacle adapted for closely-fitted reception of a corresponding male engagement portion is a matched corresponding female engagement portion of that corresponding male engagement portion. A receptacle herein means a coupling receptacle of a female building block connector unless the context requires otherwise. A coupling receptacle of a female building block connector is also referred to as a male engagement portion receptacle or a male-connector receptacle.

A pair of connectors having matched corresponding engagement portions when on separate building blocks are detachably engageable to form a releasable mechanical connection. When the pair of connectors have matched snap engagement portions, the connectors are snap engageable to form a snap engaged connector pair.

A male engagement portion and a corresponding female engagement portion having matched and compatible mating features will enter into closely fitted engagement when they are brought or moved relatively towards each other with their respective coupling axes aligned and press connected along the aligned coupling axes. The fitted or closely fitted engagement herein may be by interference fit or snap fit. When a pair of matched connectors herein are brought or moved relatively towards each other with their respective coupling axes aligned and then pressed together, the matched connectors will engage and enter into closely fitted engagement.

A connector has a characteristic radial profile. The radial profile of a connector is characterized by the radial extent of the engagement portion or the engagement portions of the connector between its axial ends. A snap connector is characterized by a non-uniform radial extent in the axial direction, and more particularly by a bulged radial profile.

A male connection portion comprises a protruding portion which is to enter into a receptacle of a corresponding female connection portion to make releasable mechanical engagement therewith. The protrusion portion may be in the form of a protrusion body, a protruding body, a protrusion member or a protruding member.

The protrusion portion of a male connection portion projects from a base surface and extends in an axial direction away from the base surface, the axial direction being with respect to the coupling axis of the protrusion portion. A male connection portion comprises a connector head defining its axial end. The axial extent of a protrusion portion, measured along the coupling axis of the male connection portion between the base surface from which it projects and its axial end, defines the height of the protrusion. The protruding body has an outer peripheral wall which defines the mating features of the protrusion portion, including shape, configuration, radial profile and dimensions.

The protrusion portion of a male snap connector has a radial profile which is defined by its outer peripheral wall. The radial profile of a snap connector is characterized by a non-uniform radial extent in the axial direction. A male snap connector typically comprises a bulged portion having a bulged radial profile and a reduced portion having a reduced radial profile.

A typical protrusion portion herein is an annular protrusion comprising a first protrusion portion and a second protrusion portion. The first protrusion portion and the second protrusion portion are in series and are aligned on the coupling axis. The first protrusion portion is in abutment with the base surface and the second protrusion portion comprises the axial end, which is usually a free axial end. The first protrusion portion is, in the axial direction, or axially, intermediate the second protrusion portion and the base surface.

The first protrusion portion is referred to as a neck portion which is supported on the base surface and the second protrusion portion is referred to as a head portion which is supported by the neck portion.

The head portion has an enlarged radial profile compared to the neck portion radial profile, and is also referred to as an enlarged portion. As the profile enlargement is in the radial direction, the head portion is also referred to as a widened portion.

In general, the head portion is an enlarged portion having a head portion radial profile which is a bulged radial profile, or a bulged profile in short.

The head portion has an outer periphery which is in the general form of a peripherally extending rib. A peripherally extending rib herein is an annular rib having the radial profile of the head portion radial profile in the peripheral direction. The annular rib is defined by the outer peripheral wall of the protrusion portion and may be continuous or non-continuous. The peripheral direction is orthogonal to the coupling axis and is a tangential direction to a circle defining the annular rib. The annular rib surrounds a core portion of the head portion, and the core portion of the head portion may be solid or hollow. When the core portion is hollow, the head portion is in the form of a hollow shell having an internal compartment. The head portion radial profile and the annular rib has the radial profile of a radial protrusion and defines an engagement portion, and more specifically, defines a male snap engagement portion of a male connection portion. The engagement portion on the head portion of a male connection portion is referred to as a first engagement portion or a first snap engagement portion of the protrusion portion or of the male connection portion for ease of reference. The terms "rib" and "ridge" are equivalent and are used interchangeably herein.

The bulged head portion has a maximum radial extent defining a maximum radial plane at an axial level with respect to the base surface. The maximum radial plane is a maximum transversal plane, and the axial level of the maximum radial plane is a maximum radial extent level.

The bulged portion has a lower surface which extends between the maximum radial plane and the base surface. The lower surface is a tapered surface which oppositely faces the base surface. The radial extent of the lower surface of the bulged head portion at an axial level decreases as the axial level moves closer towards the base level of the base surface to define a lower tapered surface. Conversely, the radial extent of the lower surface of the bulged head portion at an axial level increases as the axial level of the lower surface away from the base surface increases. The radial extent of the lower surface of the bulged head portion reaches a local minimum at an axial level where it joins the neck portion.

The head portion tapers to narrow as it extends axially from the maximum radial extent plane towards the base surface. Conversely, the head portion flares to widen as it extends axially from the base surface towards the maximum radial extent plane.

The axial free end of the head portion may be flat or rounded. Where the axial free end is flat, the male connector has a flat head. Where the axial end is rounded, the male connector has a rounded head. The rounded head may be in the shape of a dome, a spherical cap, or a rounded boss or other suitable shapes.

The head portion radial profile extends in a peripheral direction to define an annular outer periphery of the head portion and the neck portion radial profile extends in a peripheral direction to define an annular outer periphery of the neck portion.

The neck portion has reduced radial profile compared to the head portion radial profile, and is also referred to as a reduced portion. As the profile reduction is in the radial direction, the neck portion is also referred to as a narrowed portion.

In general, the neck portion is a reduced enlarged portion having a neck portion radial profile which is a tapered radial profile, or a tapered profile in short.

The neck portion has an outer periphery which is in the form of a peripherally extending channel. The peripherally extending channel is an annular channel having the radial profile of the neck portion radial profile in the peripheral direction. The annular channel is defined by the outer peripheral wall of the protrusion portion and may be continuous or non-continuous. The peripheral direction is orthogonal to the coupling axis and is a tangential direction to a circle defining the annular channel. The annular channel, that is, the peripherally extending channel, surrounds a core portion of the neck portion, and the core portion of the neck portion may be solid or hollow. When the core portion is hollow, the neck portion is in the form of a hollow shell having an internal compartment. The neck portion radial profile and the annular channel has the radial profile of a radial indentation and defines an engagement portion, and more specifically, a female snap engagement portion on a male connection portion. The engagement portion on the neck portion of a male connection portion is referred to as a second engagement portion or a second snap engagement portion of the protrusion portion or of the male connection portion for ease of reference. This second engagement portion is a retention portion which is adapted to receive and retain a neck receptacle portion of a female connector. The terms "channel" and "groove" are equivalent and are used interchangeably herein.

The neck portion has a local maximum radial extent at an axial level where it joins or is in abutment with the head portion. The local maximum radial extent defines a local maximum radial plane, which is also a local maximum transversal plane.

The neck portion has an outer peripheral surface which extends between the local maximum radial plane and the base surface. The outer peripheral surface is a tapered surface which oppositely faces the base surface. The radial extent of the outer peripheral surface of the neck portion at an axial level decreases as the axial level moves closer towards the base level of the base surface to define a tapered outer peripheral surface. Conversely, the radial extent of the outer peripheral surface of the narrowed neck portion at an axial level increases as the axial level of the outer peripheral surface away from the base surface increases. The radial extent of the outer peripheral surface of the neck portion reaches a local minimum at an axial level where it joins the head portion. The outer peripheral surface is optionally a smooth continuation of the lower surface of the head portion. Where the lower surface of the head portion follows a curved profile to taper, the radial profile of the outer peripheral surface may follow a curved profile which is a curved continuation of the curved profile to taper. In some embodiments, the curved profile follows a radius of curvature equal to half the maximum radial extent.

Therefore, the neck portion tapers to narrow as it extends axially from the local maximum radial extent plane towards the base surface. Conversely, the neck portion flares to widen as it extends axially from the base surface towards the local maximum radial extent plane.

While the peripheral channel is primarily defined by the outer peripheral surface of the neck portion in cooperation with the base surface, the entire channel may be regarded as being defined by the lower axial end of the enlarged portion, the narrowed neck portion and the base surface in cooperation.

The channel may have a constant radial extent in the axial direction or may have a tapered radial profile such that the radial extent of the neck portion decreases as its axial level decreases towards the base surface.

The tapering may follow a curved profile, for example the profile of a convex curve, a straight slope or other desired profiles without loss of generality.

In general, the axial extent of a protrusion of a connection portion is a fraction of the maximum radial extent of the protrusion, and the fraction is optionally between 20% and 80%, for example, in percentage terms, at 20, 25, 30, 35, 40, 45, 50, 55, 60, 65, 70, 75, 80, or any range or ranges defined by a combination of any of the aforesaid values and/or ranges. Typically, the axial extent will be in the higher range of between 50% and 80% where the protrusion has a rounded end or partial spherical end and in the lower range of 15% and 60% where the protrusion has a flat head or flat axial end. For an annular protrusion, the maximum radial extent E is the diameter D of a circle, the circle defines a maximum radial extent plane and the aforesaid fraction is also in respect of the diameter.

The axial extent between the maximum radial extent level and the axial free end of the protrusion portion is a fraction of the maximum radial extent of the protrusion, and the fraction is optionally between 5% and 50% of the maximum radial extent, E, at the maximum radial extent level, for example, in percentage terms, at 5, 10, 15, 20, 25, 30, 35, 40, 45, 50, or a range or any ranges formed by a combination of any of the aforesaid values as limits of a range or limits of ranges. This axial extent of the upper portion of the protrusion will be in the lower range of between 5% and 30% where the protrusion has a flat head or flat axial end, and in the higher range of between 25% and 50% where the protrusion has a rounded end or partial spherical end. When the axial extent of the upper protrusion is 50%, the upper portion has a hemispherical shape.

The axial extent between the base surface and the maximum radial extent plane of the protrusion is a fraction of the maximum radial extent of the protrusion, and the fraction is optionally between 6% and 30% of the maximum radial extent, E, for example, in percentage terms, at 6, 8, 10, 12, 15, 18, 20, 25, 30, or a range or any ranges formed by a combination of any of the aforesaid values as limits of a range or limits of ranges.

The axial extent of the bulged portion is a fraction of the maximum radial extent of the protrusion, and the fraction is optionally between 5% and 25% of the maximum radial extent, g for example, in percentage terms, at 5, 10, 15, 20, 25, or a range or any ranges formed by a combination of any of the aforesaid values as limits of a range or limits of ranges.

The axial extent of the neck portion is a fraction of the maximum radial extent of the protrusion, and the fraction is optionally between 5% and 15% of the maximum radial extent, g for example, in percentage terms, at 5, 10, 15, or a range or any ranges formed by a combination of any of the aforesaid values as limits of a range or limits of ranges.

The radial extent of the neck portion is a fraction of the maximum radial extent of the protrusion, and the fraction is optionally between 90% and 99% of the maximum radial extent, for example, in percentage terms, at 90, 91, 92, 93, 94, 95, 96, 97, 98, 99, or a range or any ranges formed by a combination of any of the aforesaid values as limits of a range or limits of ranges.

The radial extent of the radial indentation defining the channel of the neck portion is a fraction of the maximum radial extent of the protrusion, and the fraction is optionally between 1% and 6%, for example, in percentage terms, at 1, 2, 3, 4, 5, 6 or more, or a range or any ranges formed by a combination of any of the aforesaid values as limits of a range or limits of ranges.

The protrusion portion or a portion thereof may be a convex annular portion which follows a convex curvature as it extends towards the base surface in the direction of the coupling axis. The convex annular portion may have the shape of a spherical segment having a radius of curvature R, where R is half the value of the maximum radial extent of the maximum radial plane, and an axial extent or height h. The maximum radial plane is usually contained between two smaller radial planes so that the radial extent of the convexly curved portion increases from a first radial extent defined by a first smaller radial plane to the maximum radial extent and then decreases to a second radial extent defined by a second smaller radial plane as the curved portion extends along the direction of the coupling axis, the radial plane extending in a transversal direction or a lateral direction which is orthogonal to the coupling axis.

The protrusion portion between the base surface and the maximum radial plane may be in the shape of a spherical segment or a truncated cone, i.e., frusto-cone. The axial height between the base surface and the maximum radial plane is optionally between 20% and 85% of R, where R is the radius of the sphere defining the spherical segment, for example, in percentage terms, at 20, 25, 30, 35, 40, 45, 50, 55, 60, 65, 70, 75, 80, 85, or a range or any ranges formed by a combination of any of the aforesaid values as limits of a range or limits of ranges.

Where the neck portion of the protrusion portion in abutment with the base surface is in the shape of a spherical segment, the neck portion has a shape of a lower spherical segment and has a convexly curved profile in the radial direction. When the neck portion is so shaped, the neck portion has a smaller radial extent at the base surface and a local maximum radial extent at an axial separation from the base surface.

The radial extent of the neck portion at the base surface is at a fraction of the maximum radial extent, and the fraction is optionally between 90% and 98.8%, for example, in percentage terms, at 90, 92, 94, 96, 98, 98.8, or a range or any ranges formed by a combination of any of the aforesaid values as limits of a range or limits of ranges.

The local maximum radial plane is elevated above the base surface and a radial plane having a smaller radial extent is in abutment with the base surface.

The neck portion may taper to join the base surface and joins at a joining angle. The tapering may follow a convexly curved profile, may have a constant slope, or other desired tapering manner. The joining angle is an acute angle which is optionally between 50 degrees and 88 degrees, for example, in degree terms, 50, 55, 60, 65, 70, 75, 70, 80, 85, 88, or a range or any ranges defined by a combination of any of the aforesaid values and/or ranges.

The protrusion portion, for example, the bulged portion or the reduced portion, may comprise a cylindrical body or a prismatic body which projects away from the base surface, with a tapered portion formed at a peripheral region in abutment with or in proximity to the base surface.

A snap connector or the engagement portion of a snap connector herein is axis-symmetrical. An axis symmetrical engagement portion has axis-symmetrical mating feature profiles. An axis-symmetrical engagement portion or connector typically has a circular cross section at an axial defined by the coupling axis of the engagement portion or the connector. In some embodiments, the engagement portion may not be exactly axis-symmetrical but has a square cross-section or a cross-section of a regular polygon having five side, six sides, seven sides, eight side, nine sides, ten side or more. A snap connector herein includes both the axis-symmetrical and non-axis-symmetrical types unless the context requires otherwise.

On the other hand, the radial extent of a protrusion portion of a press-fit or interference-fit connector without snap-fit features is substantially uniform in the axial direction.

A female connection portion comprises a coupling receptacle for reception of a protrusion portion of a corresponding male connector. More specifically, a female connection portion comprises a coupling receptacle, or receptacle in short, for closely-fitted reception of a protrusion portion of a corresponding male connection portion to facilitate snap engagement. When a male engagement portion is in closely fitted engagement with a female engagement portion, the male engagement portion is received by the receptacle and at least a portion of the male engagement portion projects into and is received inside the receptacle compartment.

The receptacle of a female connector comprises a receptacle compartment and a receptacle entry through which an axial end of a protrusion of a corresponding male connection portion is to enter the receptacle compartment. The receptacle comprises an inner peripheral wall which defines the receptacle compartment, the receptacle entry, as well as a receptacle entry plane and an entry aperture at the receptacle entry. The entry aperture is typically on an axial end of the receptacle and is also referred to as an access aperture and the receptacle entry plane is orthogonal to the coupling axis. The entry aperture defines a minimum radial clearance of the receptacle which in turn defines a maximum radial extent of the protrusion or the bulged portion of a protrusion that can enter into the receptacle without radial deformation of the receptacle entry or the male connector protrusion. The coupling receptacle extends in the axial direction away from the receptacle entry to define an axial extent of the receptacle compartment. The axial extent of a receptacle, as measured along the coupling axis of the receptacle between the axial ends of the inner peripheral wall which defines the receptacle compartment, defines the height of the receptacle. The inner peripheral wall of the receptacle defines the shape, configuration, dimensions of the receptacle compartment. The receptacle may be in the form of a receptacle portion, a receptacle body, or a receptacle member. In some embodiments, a female connector comprises a peripheral wall which defines the receptacle. The peripheral wall may comprise an inner peripheral wall which defines the receptacle compartment and the receptacle compartment radial profile and an outer peripheral wall which surrounds the inner peripheral wall and defines the outer periphery of the receptacle. The peripheral wall may be a continuous wall or a non-continuous wall. In some embodiments, the outer peripheral wall of the receptacle depends from the panel portion and has a substantial portion of its axial extent which is spaced apart from or independent of the panel portion. For example, the outer peripheral wall may have, in percentage terms of its axial extent or of the maximum radial extent of the receptacle compartment, 55, 60, 65, 70, 75, 80, 90, 95, 100, or a range or any ranges defined by a combination of any of the aforesaid values and/or ranges which is laterally separated from the panel portion so that there is radial spatial separation between the outer peripheral wall and the panel portion from which the receptacle depends. In some embodiments, a minor portion of the axial extent of the receptacle is spaced apart from or independent of the panel portion, and the minor portion, in percentage terms of its axial extent or of the maximum radial extent of the receptacle compartment, is 5, 6, 7, 8, 9, 9, 10, or a range or any ranges defined by a combination of any of the aforesaid values and/or ranges.

A female snap connector comprises a snap-fit receptacle which is shaped and dimensioned for closely fitted engagement of a male snap engagement portion. When a female snap connector and a male snap connector are in closely-fitted snap engagement, the male engagement portion is subject to a small radially inward compression force exerted radially inwardly by the receptacle functioning as a female engagement portion, and the receptacle is subject to a small radial outward expansion force which is exerted radially outwardly by the male engagement portion.

The receptacle compartment of a female connector has a radial profile which is defined by the inner peripheral wall of the receptacle. The radial profile of the receptacle compartment of a female snap connector is characterized by a non-uniform radial extent in the axial direction, and typically includes a bulged radial profile of a bulged receptacle portion and a reduced radial profile of a reduced receptacle portion in the axial direction. The terms receptacle, coupling receptacle, snap-fit receptacle, receptacle portion, receptacle body, and receptacle member are interchangeably used herein unless the context requires otherwise.

The entry aperture is on or at one axial end of the receptacle and is an annular aperture which provides access for a male engagement portion so that a male engagement portion can enter into the receptacle compartment through that axial end and through the entry aperture and then enter into closely-fitted engagement with the receptacle. A receptacle may have an entry aperture on each of the two axial ends of the receptacle to facilitate entry or exit of a protrusion portion of a male connector from a selected one of the two axial ends.

The entry aperture has or may have a radial clearance which is smaller or slightly smaller than the maximum radial extent of a male engagement portion, and the maximum radial extent of a male engagement portion is typically located on the bulged portion of the male connector protrusion. A smaller radial clearance at the entry aperture than the maximum radial extent of the bulged portion usually means a radial constriction at the axial end of the receptacle. The bulged portion of a male connection means would need to overcome the radial constriction in order to enter the receptacle compartment from outside the receptacle compartment or to leave the receptacle if already inside the receptacle compartment. A minimum radial clearance extent of the receptacle is defined at the entry aperture.

A receptacle may comprise a first receptacle portion having a first receptacle compartment and a second receptacle portion having a second receptacle compartment. The first receptacle portion and the second receptacle portion are in series and are aligned on the coupling axis. The first receptacle portion has an axial end comprising the receptacle entry and the second receptacle portion extends axially away from the first receptacle portion and the receptacle entry. The first receptacle portion is to surround and snap on the neck portion of a corresponding male engagement portion upon snap engagement therewith and is referred to as a neck receptacle portion. The neck receptacle portion is also referred to as a neck portion engagement portion and comprises a neck receptacle compartment. The second receptacle portion is to surround and snap on the head portion of a corresponding male engagement portion upon snap engagement therewith and is referred to as a head receptacle portion. The head receptacle portion is also referred to as a head portion engagement portion and comprises a head receptacle compartment. The two receptacle portions, namely, the head receptacle portion and the neck receptacle portion, may be separate or integrally formed.

The engagement portion of a receptacle portion is an annular receptacle portion defined by a portion of the inner peripheral wall of the receptacle defining the receptacle portion. The engagement portion may be in the embodiments of an annular bracket portion, an annular bracket member, an annular collar portion, or an annular collar member. In some embodiments, a receptacle portion has an access aperture at each of its axial ends to facilitate entry and/or exit of a matched male engagement portion at either axial end.

In some embodiments, the receptacle may have only one receptacle portion, for example, only the head receptacle portion or only the neck receptacle portion.

The head receptacle portion comprises a head receptacle compartment which is adapted for making snap engagement with the head portion of a corresponding male connector, and has a radial clamping profile which is complementarily shaped and sized to match the radial profile of the bulged portion of the corresponding male connector.

The head receptacle portion is an enlarged receptacle portion, also referred to as a widened receptacle portion, or an enlarged portion in short. The head receptacle portion has a head receptacle portion radial profile which is an enlarged radial profile compared to the neck receptacle portion radial profile. The head receptacle portion radial profile extends in a peripheral direction to define an annular inner periphery of the head receptacle portion. The head receptacle portion radial profile and the inner periphery of the head receptacle portion is defined by a portion of the inner peripheral wall of the receptacle defining the head receptacle portion. The engagement portion of a head receptacle portion is typically in the form of an annular clamp or clip, and in example embodiments in the form of an annular bracket portion, an annular bracket member, an annular collar portion, or an annular collar member. The maximum radial clearance extent of the receptacle is usually defined in the head receptacle portion.

The portion of the inner peripheral wall of the receptacle defining the head receptacle portion and the head receptacle compartment has a radial profile of an indentation or a recess, with the indentation or access inwardly facing the coupling axis. The indentation has a radial profile which defines the head receptacle portion radial profile. The radial profile may be angled or curved and extends peripherally in a peripheral direction, that is annularly, to define the head receptacle compartment and its boundary. The peripheral direction is orthogonal to the coupling axis and is a tangential direction to a circle defining the annular clamp or clip. The annular clamp or clip is in the form of an annular channel which surrounds a core portion of the head receptacle portion. The head receptacle portion defines a female snap engagement portion of the female connection portion, and is referred to as a first engagement portion or a first snap engagement portion of the receptacle, or of the female connection portion, for ease of reference. The terms "channel" and "groove" are used interchangeably herein.

The head receptacle compartment has a maximum radial extent defining a maximum radial clearance and a maximum radial plane at an axial level referred to a maximum radial extent level. The maximum radial plane is also a maximum transversal plane. The radial extent of the head receptacle portion decreases as the axial distance from the maximum radial extent level increases. Specifically, the radial extent of the head receptacle portion decreases as the head receptacle portion extends away from the maximum radial extent level and towards the receptacle entry, and the radial extent of the head receptacle portion decreases as the head receptacle portion extends away from the maximum radial extent level and away from the receptacle entry. Therefore, the head receptacle portion tapers to narrow as its axial distance away from the maximum radial extent plane or the maximum radial extent level increases. Conversely, the head receptacle portion flares to widen as it extends axially towards the maximum radial extent plane or the maximum radial extent level.

The axial end of the head receptacle portion distal to the receptacle entry may be flat or curved, for example, may have the shape of a spherical cap or other desired shapes.

The neck receptacle portion comprises a neck receptacle compartment which is adapted for making snap engagement with the neck portion of a corresponding male connector and has a radial clamping profile which is complementarily shaped to match the radial profile of the neck portion of the corresponding male connector.

The neck receptacle portion is a reduced receptacle portion compared to the head receptacle portion radial profile. The neck receptacle portion is a reduced receptacle portion, since it has a neck receptacle portion radial profile which is smaller than the radial profile of the head receptacle portion radial profile. The reduced receptacle portion is also referred to as a narrowed receptacle portion, or a reduced portion in short. The neck receptacle portion radial profile is defined by a portion of the inner peripheral wall of the receptacle which defines the neck receptacle portion and the inner periphery of the neck receptacle portion. The neck receptacle portion radial profile extends in a peripheral direction to define an annular inner periphery of the neck receptacle portion. The portion of the inner peripheral wall of the receptacle which defines the neck receptacle portion and the neck receptacle compartment has a radial profile of an indentation or a recess, and the indentation or access is inwardly facing the coupling axis and the centre of the maximum radial plane of the head receptacle portion. The indentation has a radial profile which is or which defines the neck receptacle portion radial profile. The radial profile may be angled or curved and extends peripherally in a peripheral direction, that is annularly, to define a neck receptacle compartment and its boundary.

The engagement portion of an example neck receptacle portion is in the form of an annular clamp or an annular clip which surrounds and defines the neck receptacle portion. The annular clamp or clip may have a radial profile of a clamping bracket or a clamping collar. The neck receptacle portion in exemplary embodiments is in the form of an annular bracket portion, an annular bracket member, an annular collar portion, or an annular collar member. The terms "bracket" and "collar" are interchangeably used herein and shall bear the same meaning unless the context requires otherwise. A clamping bracket herein is an inclined bracket having a recess or indentation facing the coupling axis and the centre of the maximum radial plane of the head receptacle portion. The bracket extends peripherally in a peripheral direction to define a neck receptacle compartment portion and its boundary. The peripheral direction is orthogonal to the coupling axis and is a tangential direction to a circle defining the annular clamp or clip. The neck receptacle portion defines a female snap engagement portion of the female connection portion, and is referred to as a second engagement portion or a second snap engagement portion of the receptacle, or of the female connection portion, for ease of reference. This second engagement means, similar to the first engagement means, is a retention portion defining a female retention means. The minimum radial clearance extent of the receptacle is usually defined in the neck receptacle portion.

The reduced receptacle portion has a local maximum radial extent defining a local maximum radial plane at an axial level referred to a local maximum radial extent level. The local maximum radial plane is also a local maximum transversal plane. The radial extent of the neck receptacle compartment decreases as the axial distance away from the local maximum radial extent level towards the receptacle entry increases. Specifically, the radial extent of the neck receptacle compartment decreases as the neck receptacle compartment extends away from the local maximum radial extent level and towards and joins the receptacle entry. The neck receptacle compartment is a tapered receptacle portion which tapers to narrow as it extends axially towards the receptacle entry. Conversely, the neck receptacle compartment flares to widen as it projects axially away from the receptacle entry.

The tapered entry end of the neck receptacle portion is optionally shaped and sized to operate as an engagement portion, or more specifically a male engagement portion, for engaging with or snap on the narrowed neck portion of the corresponding male connection portion, for example, by wedged engagement. Therefore, this tapered entry end be regarded as a third snap engagement portion of the receptacle.

The tapering may follow a curve, for example, a concave curve, a straight slope or other desired profiles without loss of generality.

The receptacle of a female connection portion is adapted to accommodate the protrusion of a male connection portion such that when two building blocks having matched connection means are stacked and their matched corresponding connection means in releasable engagement, the corresponding connection surfaces of the building blocks are in flush abutment and even contact. To meet the accommodation requirements, the axial end or ceiling of the receptacle compartment which is distal to the entry end would need to be at an axial level sufficient to accommodate the protrusion.

Where the entry end of the receptacle is at the axial level of the connection surface, as is usually the case, the ceiling end of the receptacle would be at an axial level corresponding to the axial extent of the protrusion from the connection surface, unless the ceiling end is an open end that allows the protrusion to pass through. In general, the axial extent of the receptacle compartment is a fraction of the maximum radial extent, E, of the protrusion or of the receptacle, and the fraction is optionally between 15% and 80%, for example, in percentage terms, at 15, 20, 25, 30, 35, 40, 45, 50, 55, 60, 65, 70, 75, 80, or a range or any ranges defined by a combination of any of the aforesaid values and/or ranges. Typically, the axial extent will be in the higher range of between 50% and 80% where the protrusion has a rounded end or partial spherical end and in the lower range of 15% and 60% where the protrusion has a flat head or flat axial end.

A head receptacle portion which is adapted to snap on the bulged portion has a radial clamping profile which is complementarily shaped to match the radial profile of the bulged of the head portion.

In order to provide sufficiently effective snap griping on the bulged portion, the axial extent of the radial clamping profile of the head receptacle portion, which is determined by the radial profile of the annular bracket, would be comparable to the axial extent of the bulged portion of the corresponding male engagement portion. In general, the axial extent of the head receptacle portion would be a fraction of the maximum radial extent of the bulged portion, and the fraction would optionally be between 10% and 40%, for example, in percentage terms, at 10, 12, 14, 16, 18, 20, 22, 24, 26, 28, 30, 32, 34, 36, 38, 40, or a range or any ranges formed by a combination of any of the aforesaid values as limits of a range or limits of ranges.

The head receptacle portion is optionally symmetrical about a radial plane of symmetry, which corresponds to the maximum radial extent plane of the bulged receptacle portion or the bulged portion of the protrusion on snap engagement. The plane of symmetry divides the head receptacle portion into symmetrical halves about the radial plane of symmetry. The head receptacle portion tapers to narrow as it extends axially away from the maximum radial extent plane to taper. The head receptacle portion optionally follows a concave profile or has a concave radial profile as it extends axially to taper. Optionally, the concave profile follows or matches the convex profile of the corresponding bulged portion. In some embodiments, the concave profile follows a concave curvature having a diameter equal to or comparable to the maximum radial extent of the bulged portion. The tapering may follow a straight slope or other desired profiles without loss of generality. The concave curve may have a radius of curvature comparable to half the maximum radial extent E.

The radial extent of the head receptacle portion at an axial end of the head receptacle portion where symmetry about the plane of symmetry ends is a fraction of the maximum radial extent of the bulged receptacle portion, and the fraction would optionally be between 95% and 99%, for example, in percentage terms, at 95, 96, 97, 98, 99, or a range or any ranges formed by a combination of any of the aforesaid values as limits of a range or limits of ranges.

The neck receptacle portion has an axial extent to provide snap grip on the neck portion of the male connector. The axial extent is a fraction of the maximum radial extent of the bulged portion which, in percentage terms, is optionally between 2 and 10, for example, at 2, 3, 4, 5, 6, 7, 8, 9, 10, or a range or any ranges defined by a combination of any of the aforesaid values and/or ranges.

In order to provide sufficient or effective snap clamping on the neck portion of the protrusion, the axial extent of the radial clamping profile of the neck receptacle portion, which is the radial profile of the annular bracket, would be comparable to the axial extent of the neck portion of the corresponding male engagement portion. In general, the axial extent of the neck receptacle portion would be a fraction of the radial extent of the neck portion at the base surface, and the fraction would optionally be between 10% and 35%, for example, in percentage terms, at 10, 12, 14, 16, 18, 20, 22, 24, 26, 28, 30, 32, 35, or a range or any ranges formed by a combination of any of the aforesaid values as limits of a range or limits of ranges.

The axial extent of the neck receptacle portion can be expressed as a fraction of the maximum radial extent of the receptacle, and the fraction would optionally be between 1.9% and 5%, for example, in percentage terms, at 1.9, 2, 2.0, 2.5, 3, 3.5, 4, 4.0, 4.5, 5, or a range or any ranges formed by a combination of any of the aforesaid values as limits of a range or limits of ranges.

The neck receptacle portion tapers to narrow as it extends axially towards the access aperture to define a narrowed access aperture to facilitate snap fit.

As a result of the tapering, the access aperture at the tapered axial end of the neck receptacle portion has a radial extent which is a fraction of the maximum radial extent of clearance of the internal compartment of the receptacle, and the fraction is optionally between 85% and 96%, for example, in percentage terms, at 85, 90, 95, 96, or a range or any ranges formed by a combination of any of the aforesaid values as limits of a range or limits of ranges.

As a result of the tapering, the inner peripheral wall of the neck receptacle portion is at an inclination angle to a radial plane at the access aperture axial end of the neck receptacle portion. The inclination angle is optionally between 50 degrees and 88 degrees, for example, in degree terms, 50, 55, 60, 65, 70, 75, 70, 80, 85, 88, or any range or ranges defined by a combination of any of the aforesaid values and/or ranges. Preferably, the inclination angle corresponds to the joining angle to facilitate closely fitted engagement between the neck receptacle portion and the neck portion.

Where the receptacle comprises both the neck receptacle portion and the head receptacle portion, both the neck receptacle portion and the head receptacle portion may be defined by an integrally formed peripheral wall of the receptacle, and the axial extent of the peripheral wall of the receptacle would optionally be between 30% and 85% of R, for example, in percentage terms, at 30, 35, 40, 45, 50, 55, 60, 65, 70, 75, 80, 85, or a range or any ranges defined by a combination of any of the aforesaid values and/or ranges.

FIGURES

Figure 1C:
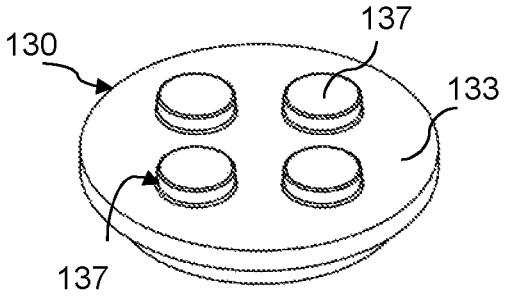
Figure 1B:
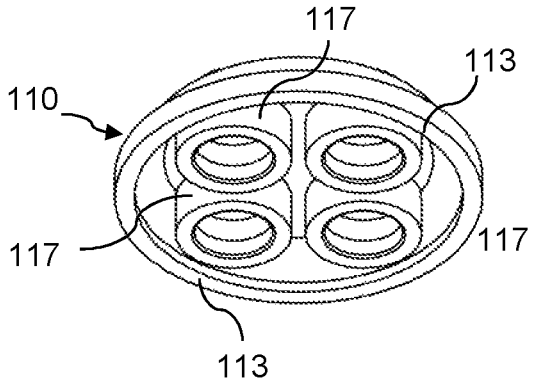
Figure 1B:
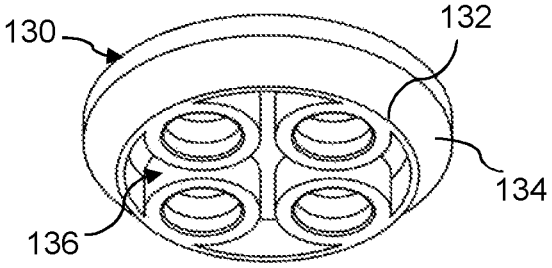
Figure 1B:
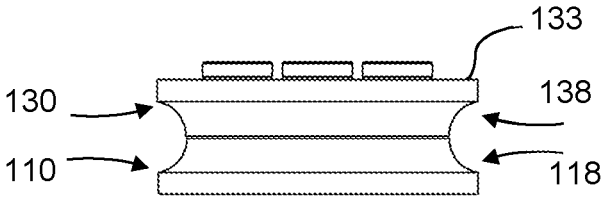
Figure 1C:
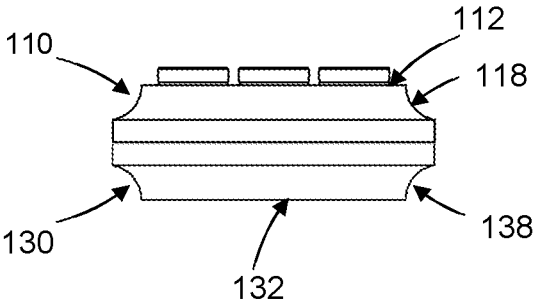
Figure 1D:
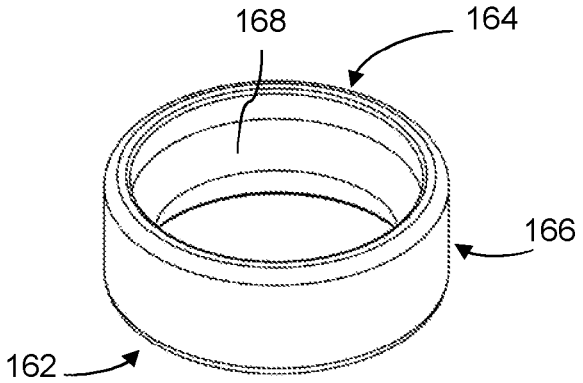
Figure 1E:
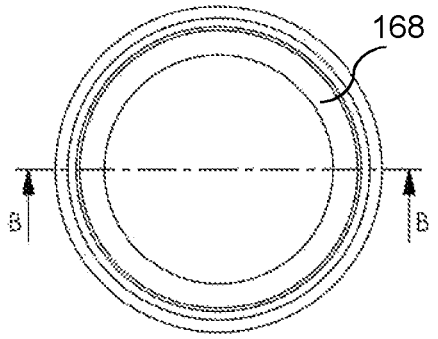
Figure 1E:
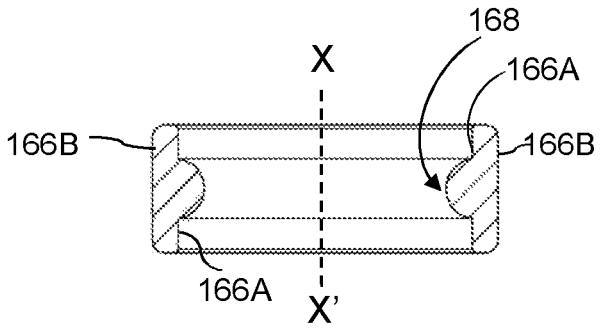
Figure 1E:
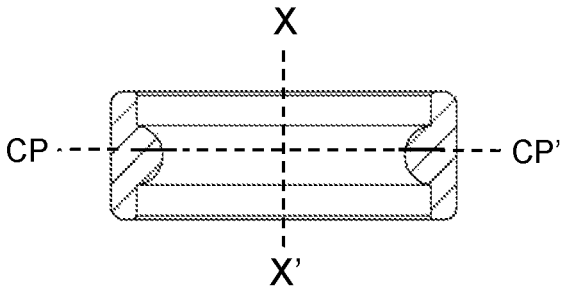
Figure 1E:
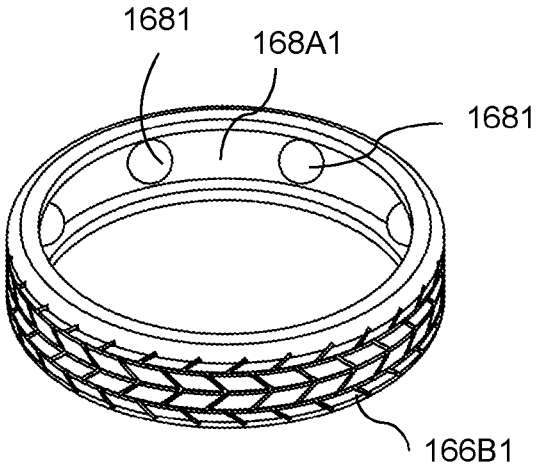
Figure 4A:
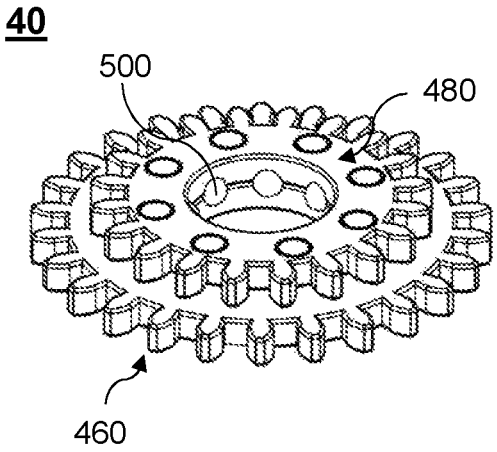
Figure 4B:
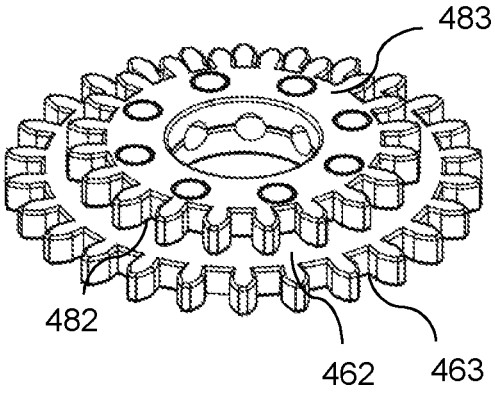
Figure 4C:
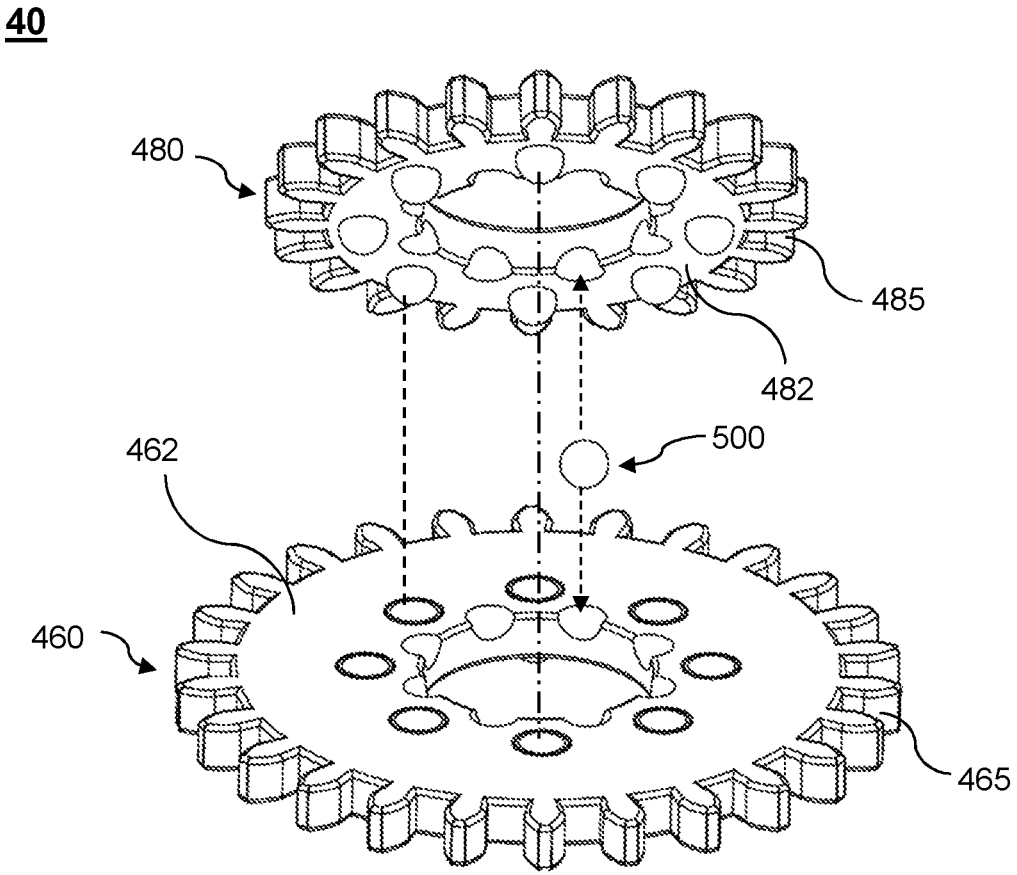

The disclosure is described by way of example with reference to the accompanying figures, in which:

FIG. 1 is a perspective view of an example building block assembly from an axial end, FIG. 1A1 is an exploded view of the assembly of FIG. 1, FIG. 1A2 is a perspective view taken from another axial end of the assembly of FIG. 1, FIG. 1A3 is a plan view of the assembly of FIG. 1 showing a section line A-A, FIG. 1A4 is a cross-sectional view of the assembly of FIG. 1 taken along section line A-A of FIG. 1A3, FIGS. 1B and 1B1 are perspective views of a building block of the assembly of FIG. 1 taken from opposite axial ends, FIGS. 1C and 1C1 are perspective views of another building block of the assembly of FIG. 1 taken from opposite axial ends, FIG. 1BC is a side elevation view of an example building block module of the assembly of FIG. 1, FIG. 1CB is a side elevation view of another example building block module constructed from the building blocks of FIGS. 1B and 1C, FIG. 1D is a perspective view of another example building block module of the assembly of FIG. 1, FIG. 1D1 is a plan view of the module of FIG. 1D showing a section line B-B, FIG. 1D2 is a cross-sectional view of the module of FIG. 1D taken along the section line B-B of FIG. 1D1, FIG. 1D3 is a cross-sectional view of example module compatible to the module of FIG. 1D2, FIG. 1E is a perspective view of another example module compatible with the module of FIG. 1D2, FIG. 2 is a perspective view of an example building block assembly from an axial end, FIG. 2A1 is an exploded view of the assembly of FIG. 2, FIG. 2A2 is a plan view of the assembly of FIG. 2 showing a section line C-C, FIG. 2A3 is a cross-sectional view of the assembly of FIG. 2 taken along section line C-C of FIG. 2A2, FIGS. 2B and 2B1 are perspective views of a building block module of the assembly of FIG. 2 taken from opposite axial ends, FIG. 2B2 is a side elevation view of the building block module of FIG. 2B, FIGS. 2C and 2C1 are perspective views of another building block module of the assembly of FIG. 2 taken from opposite axial ends, FIGS. 2C2 and 2C3 are plan views taken from opposite axial ends of the module of FIG. 2C, FIG. 2D1 is a bottom view of the example building block of FIG. 2C, FIG. 2D2 is a bottom view of the example building block of FIG. 2C with bearing balls inserted, FIG. 3 is a perspective view of an example building block assembly, FIG. 3A is a perspective view of a module of the assembly of FIG. 3, FIG. 3A1 is an exploded view of the module of FIG. 3A, FIG. 3B is a perspective view of another module of the assembly of FIG. 3, FIG. 4A is a perspective view of an example module, FIG. 4B is a perspective view of the module of FIG. 4A with bearing balls removed, FIG. 4C is an exploded view of the module of FIG. 4A, FIGS. 5 and 5A are perspective views of an example building block assembly 50, FIG. 5B is a perspective view of a building block module 50B of the building block assembly 50 of FIG. 5, FIGS. 5C1, 5C2 and 5C3 are perspective and elevation views of the building block 580 of the building block module 50B, and FIGS. 5D1, 5D2 and 5D3 are perspective and elevation views of the building block 580 of the building block module 50B.

DESCRIPTION

An example building block assembly 10 comprises a first module 10A and a second module 10B which are releasably fastened to form the assembly 10, as depicted in FIG. 1. The first module 10A and the second module 10B are relatively rotatable about a rotation axis X-X', as depicted in FIGS. 1A1 and 1A4. The first module 10A comprises a first building block 110 and a second building block 130 which are snap fastened and joined on a connection plane. The first module 10A and the second module 10B are retained in a retention state by a retention means. When in the retention state, the first module 10A and the second module 10B are interlocked and maintained as a single assembly, with the first module 10A and the second module 10B relatively rotatable about a common rotation axis which is the rotation axis.

The first building block 110 comprises a main body having a first surface 112, a second surface 113 and a peripheral surface 114 extending between the first surface 112 and the second surface 113. Referring to FIGS. 1A1, 1A4, 1B, 1B1, and 1BC, a plurality of snap connectors 116 is formed on the first surface 112 to form a first connection means and define a first connection surface of the first building block 110. Each snap connector 116 comprises a connection portion having a coupling axis which is characteristic of the connection portion. The connection portion comprises an engagement portion having mechanical mating features for entering into snap engagement with a corresponding engagement portion of a matched corresponding connector. The first connection means of the first connection surface defines a connection direction along which the first connection means is to enter into snap engagement with a corresponding engagement means on a corresponding connection surface of a matched corresponding connector.

One connector 117 or a plurality of connectors 117 is formed on the second surface 113 which is a second connection surface of the first building block 110, as depicted in FIG. 1B1. The connectors 117 are optionally press-fit connectors such as snap-fit connectors, but can be or can comprise other types of mechanical connectors having releasable engagement features.

The first surface 112 is the top panel surface of a panel portion of the main body having a top panel surface and a bottom panel surface. The peripheral surface 114 is the outer peripheral surface of a peripheral portion of the main body, the peripheral portion having an inner peripheral surface and an outer peripheral surface which surrounds the inner peripheral surface. The bottom panel surface and the inner peripheral surface of a peripheral portion of the main body cooperate to define an internal compartment of the main body. The connectors 117 project from the bottom panel surface and extend in an axial direction of the coupling axes of the connectors 117 to approach a transversal plane defined by the second surface 113. The second surface 113 is defined by the bottom edge of the peripheral wall portion of the main body. The bottom edge of the peripheral wall portion of the main body defines a main access aperture for entry into the internal compartment and to the connectors 117.

In this example, each of the first surface and the second surface is an axis symmetrical surface in the form of a circular surface which is axis symmetrical about a center axis, and the center axis of the first surface and the second surface are coaxial. In some embodiments, each of the first surface and the second surface may be a substantially axis symmetrical regular polygon such as a square or a regular polygon having more than 4 equal sides. For example, the regular polygon may have, 6, 7, 8, 9, 10, equal sides. The first surface and the second surface are preferably coaxial when the assembly is to operate as a rotation assembly.

The peripheral portion is a radial outward projection which projects radially outwards from the outer periphery of the first surface 112. The outer peripheral surface of the peripheral portion extends axially downwards as it projects radially outwards to join the second surface 113 at an axial end of the first building block 110, as the second surface 113 is a radially enlarged surface compared to the first surface 112. The outer peripheral surface of the peripheral portion follows a curved profile to form a concaved peripheral portion as it extends from the first surface 112 towards the second surface 113. The outer peripheral surface changes from a curved profile to a straight profile as it extends further away from the first surface 112 to join the second surface 113. As depicted in FIG. 1B, the outer peripheral surface changes to extend in a direction orthogonal to the second surface 113 at the lower axial end of the curved profile and forms an outer rim or a peripheral flange having a constant radial extent. The lower axial end of the curved profile is at an axial distance from the second surface 113 which axial distance defining an axial extent equal to the thickness of the outer rim or the peripheral flange. In some embodiments, the thickness is comparable to or slightly larger than the thickness of the panel portion or the peripheral wall portion for sufficient strength or robustness. The peripheral portion is a first partial peripheral retention portion which is to combine with a corresponding second partial peripheral retention portion of the second building block 130 to form a peripheral retention portion of the first module 10A. The first partial peripheral retention portion and the second partial peripheral retention portion are examples of peripheral formations.

The second building block 130 comprises a main body having a first surface 132, a second surface 133 and a peripheral surface 134 extending between the first surface 132 and second surface 133, as depicted in FIGS. 1A1, 1A4, 10, 101, plurality of snap connectors 136 is formed on the first surface 132 to form a first connection means and define a first connection surface of the second building block 130. Each snap connector 136 comprises a connection portion having a coupling axis which is characteristic of the connection portion. The connection portion comprises an engagement portion having mechanical mating features for entering into snap engagement with a corresponding engagement portion of a matched corresponding connector. The first connection means of the first connection surface defines a connection direction along which the first connection means is to enter into snap engagement with a corresponding engagement means on a corresponding connection surface of a matched corresponding connector, for example, the first connection means on the first surface 112 of the first building block 110.

One connector 137 or a plurality of connectors 137 is formed on the second surface 133 which is a second connection surface of the second building block 130. The connectors 137 are optionally press-fit connectors such as snap-fit connectors, but can be or can comprise other types of mechanical connectors having releasable engagement features.

The second surface 133 is the bottom panel surface of a panel portion of the main body having a top panel surface and a bottom panel surface. The peripheral surface 134 is the outer peripheral surface of a peripheral portion of the main body, the peripheral portion having an inner peripheral surface and an outer peripheral surface which surrounds the inner peripheral surface. The bottom panel surface and the inner peripheral surface of a peripheral portion of the main body cooperate to define an internal compartment of the main body. The connectors 136 project from the bottom panel surface and extend in an axial direction of the coupling axes of the connectors 136 to approach a transversal plane defined by the first surface 132.

The first surface 132 is defined by the bottom edge of the peripheral wall portion of the main body. The bottom edge of the peripheral wall portion of the main body defines a main access aperture for entry into the internal compartment and to the connectors 136.

In this example, each of the first surface and the second surface is an axis symmetrical surface in the form of a circular surface which is axis symmetrical about a center axis, and the center axis of the first surface and the second surface are coaxial. In some embodiments, each of the first surface and the second surface may be a substantially axis symmetrical regular polygon such as a square or a regular polygon having more than 4 equal sides. For example, the regular polygon may have 6, 7, 8, 9, 10, equal sides. The first surface and the second surface are preferably coaxial when the assembly is to operate as a rotation assembly.

The peripheral portion is a radial outward projection which projects radially outwards from the outer periphery of the first surface. The outer peripheral surface of the peripheral portion extends axially upwards as it projects radially outwards to join the second surface 133 at an upper axial end of the main body, as the second surface 133 is a radially enlarged surface compared to the first surface 132. The outer peripheral surface of the peripheral portion follows a curved profile to form a concaved peripheral portion as it extends from the first surface towards the second surface. The outer peripheral surface changes from a curved profile to a straight profile as it extends further away from the first surface 132 to join the second surface 133. As depicted in FIG. 1C, the outer peripheral surface changes to extend in a direction orthogonal to the second surface at the upper axial end of the curved profile and forms an outer rim or a peripheral flange having a constant radial extent proximal the second surface 133. The upper axial end of the curved profile is at an axial distance from the second surface which axial distance defines an axial extent equal to the thickness of the outer rim or the peripheral flange. In some embodiments, the thickness is comparable to or slightly larger than the thickness of the panel portion or the peripheral wall portion for sufficient strength or robustness. The peripheral portion is a second partial peripheral retention portion which is to combine with a corresponding first partial peripheral retention portion of the first building block 110 to form a peripheral retention portion of the first module 10A.

In this example, the main body of the first building block 110 and the main body of the second building block 130 are mirror symmetrical about the connection plane or identical. With the mirror symmetry, the first surface 112 of the first building block 110 and the first surface 132 of the second first building block 130 have same dimensions and are matched surfaces, the second surface 113 of the first building block 110 and the second surface 133 of the second building block 130 have the same dimensions and are matched surfaces, and the peripheral portions of the first building block 110 and the second first building block 130 are mirror symmetrical about the connection plane.

The first connection means of the first building block 110 and the first connection means of the second building block 130 are matched and complementary snap connection means which are snap connectible to form a snap connection.

In the example, the first connection means of the first building block 110 and the first connection means of the second building block 130 are snap joined with the corresponding first connection surfaces of the first building block and the second building block in abutment contact at the connection plane to form the example first module 10A. When the first building block 110 and the second building block 130 are snap joined, the first building block 110 and the second building block 130 are stack-connected with their corresponding first connection surfaces aligned with a common center axis and in abutment contact to form the connection plane.

When the first connection means of the component building blocks of the assembly, that is, the first building block 110 and the second building block 130, are snap connected to form the assembly, the first connection means of the first building block 110 and the corresponding first connection means of the second building block 130 are snap connected with the first connection surfaces of the component building blocks in abutment. When in such an abutment state, the first connection means of the first building block is inside the internal compartment of the second building block 130, and the first connection means is also referred to as an internal connection means for ease of reference. On the other hand, the connection means on the second surfaces are for making external connection and will be referred to as an external connection means for ease of reference.

Referring to FIG. 1BC, the first module has a first axial end defined by the second surface 113 of the first building block, a second axial end defined by the second surface 133 of the second building block and a peripheral portion extending between the first axial end and the second axial end and defined by the first retention portion. The exterior peripheral surface of the peripheral portion defines a first retention surface of the first retention portion. The radial profile of the first retention surface is a combination radial profile formed by a stacked combination of the radial profile of the first partial peripheral retention portion of the first building block 110 and the radial profile of the second partial peripheral retention portion of the second building block 130.

The first module 10A comprises a first retention portion which is to cooperate with a second retention portion of the second module 10B to form the retention means of the assembly and to retain or maintain the first module 10A and the second module 10B in an interlocked but relatively rotatable relationship, as depicted more particularly in FIGS. 1BC and 1A4. When the first module 10A and the second module 10B are maintained in this interlocked and relatively rotatable relationship, the first retention portion and the second retention portion cooperate to restrain or resist relative movement between the first module 10A and the second module 10B in an axial direction of the rotation axis X-X' or to contain the relative movement within a tight tolerance while permitting relative rotation between the first module 10A and the second module 10B in a rotation direction defined by the rotation axis and to maintain the first module 10A and the second module 10B in the retention state in which the first module and the second module are interlocked or inter-latched. To facilitate rotatable retention in the aforesaid manner, the first module 10A and the second module 10B are somewhat loosely fitted together so that a small gap is present between the first retention portion and the second retention portion. The small gap is controlled within a tight tolerance so that the relative rotation between the first module 10A and the second module 10B is maintained in a rotation plane which is substantially orthogonal to the rotation axis. As an example, the rotation plane may have an angular deviation from the orthogonal plane defined by the rotation axis, and the angular deviation, in unit of angle, may be 0.3°, 0.5°, 0.8°, 1.0°, 1.1°, 1.3°, 1.5°, 1.8°, 2.0°, 2.1°, 2.3°, 2.5°, 2.8°, 3.0°, 3.1°, 4.0°, 4.1°, or a range or any ranges formed by a selected combination of any of the aforesaid values as limits of a range or limits of ranges. In addition to maintaining the assembly in the interlocked retention state, the retention means also functions as a rotation guide to facilitate relative rotation between the first module and the second module about a rotation plane which is substantially orthogonal to the center axis of the assembly.

A first retention portion in this example has a first retention profile in a radial direction with respect to the rotation axis and a second retention portion has a second retention profile in the radial direction. The first retention profile and the second retention profile are complementary profiles which cooperate to restrain or resist relative movement between the first module and the second module in the axial direction or to contain the relative movement within a tight tolerance while permitting relative rotation between the first module and the second module in the rotation direction. To facilitate rotatable retention in the aforesaid manner, that is to maintain the modules in interlocked relationship while permitting relative rotation in the rotation plane, the modules are slightly in a loose fit with a peripheral gap with a very tight tolerance.

In an example, the building block assembly 10 is configured as a toy wheel having an outer diameter of, in unit of cm, 2, 3, 4, 5, 6, 7, 8, 9, 10, 12, 14, 16, 18, 20, 25, 30 or more, or a range or any ranges formed by a selected combination of any of the aforesaid values as limits of a range or limits of ranges, and the gap may be, in unit of mm, 0.05, 0.075, 0.1, 0.125, 0.15, 0.15, 0.2, 0.25, 0.3, 0.35, 0.4, 0.45, 0.5, 1, or a range or any ranges formed by a selected combination of any of the aforesaid values as limits of a range or limits of ranges.

In general, the gap may relate to the maximum radial extent of the retention profile, in percentage terms, of 1, 2, 3, 4, 5, 6, 7, 8, or a range or any ranges formed by a selected combination of any of the aforesaid values as limits of a range or limits of ranges.

The first retention portion of the first module 10A is a peripherally extending retention means for retaining the second module 10B. The first retention portion is formed by stacked connection of the corresponding partial peripheral retention portions of the first building block 110 and the second building block 130 with the corresponding first connection surfaces of the first building block and the second building block in abutment contact. Referring to FIG. 1BC, the radially innermost end of the first partial peripheral retention portion of the first building block and the radially innermost end of the second partial peripheral retention portion of the are aligned and connected in abutment to form the first retention portion of the first module 10A.

The example peripheral retention means of the first module 10A comprises a peripherally extending channel, or a peripheral channel in short. The peripheral channel is an elongate groove that extends radially with respect to the rotation axis and peripherally along a radial plane in a peripheral direction which is orthogonal to the rotation axis to surround the smaller one of the first surface and the second surface, the peripheral direction being orthogonal to the rotation axis. The channel has a retention profile in the radial direction.

In this example, the retention profile is in the form of a radial indentation. The example indentation is a tapered indentation which tapers to narrow as the indentation extends radially inwards towards the rotation axis and has a rounded indentation end at its innermost radial end. As the indentation is tapered, the axial extent (with respect to the rotation axis) of the aperture of the indentation decreases as it extends inwardly towards the rotation axis. In this example, the retention profile proximal the rotation axis follows a concave curve which is symmetrical about the joining plane. A round retention profile, for example, a rounded retention profile or a curved retention profile would help reduce friction and improves relative rotatability. In some embodiments, the indentation may have a non-rounded profile, for example, an angular profile defined by some sides of a polygon without loss of generality. To enhance relative rotatability, the correspondence proximal surfaces of the correspond retention means of the first module 10A and the second module 10B are low friction surfaces, for example, are made of a low friction material such as ABS, PC, and/or polished to form smooth and low friction surfaces.

In this example, the retention profile is uniform in the peripheral direction to facilitate complete circular revolutions about the rotation axis, the peripheral direction being tangential to the retention profile as depicted in FIG. 1D2. Where the relative rotation is to be limited to within an angular range smaller than 360 degrees, the uniform retention profile may extend only for a portion of the periphery of the first module 10A to limit the range of relative rotation.

In this example, the peripheral channel forms a bearing race along which the peripheral rib is to slide to the peripheral channel to facilitate relative rotation between the first module and the second module.

A plurality of snap connectors is distributed on the first connection surface of the first building block and a corresponding plurality of snap connectors is distributed on the first connection surface of the second building block and the snap connectors on the first connection surfaces of the first building block and the second building block are to enter into snap engagement to form the first module.

The snap connectors 116, 117, 136, 137 on the first connection surface of the example building blocks 110 and 130 are distributed in a circular manner and surrounds the rotation axis X-X'. In some embodiments, the first connection surface includes a snap connector having its coupling axis aligned with the rotation axis as an addition to the plurality of snap connectors or as a sole snap connector on the first connection surface. The snap connector on the rotation axis may be a ball connector having more than one coupling directions to permit more flexible connection.

The snap connectors 116, 117, 136, 137 on the same first connection surface or on the same second connection surface are of the same gender. For example, the snap connectors 117 and 136 are female snap connectors and the snap connectors 116 and 137 are male snap connectors. In some embodiments, the snap connectors on a first connection surface or on a second connection surface can comprise both male snap connectors and female snap connectors. A connection surface comprising both male and female snap connections is a hybrid connection surface. A building block having a hybrid first connection surface is advantageous, since, for example, building blocks having identical hybrid first connection surfaces can be snap connected, and this would reduce the number of component or component first connection surfaces. The snap connectors 116, 117, 136, 137 on the first connection surface of the example building blocks 110 and 130 are distributed in a circle or at corners of a square. Where snap connectors are distributed with even or uniform spacing on a circle or where snap connectors are distributed on four corners of a square, and with adjacent snap connectors having opposite mating genders, a pair of identical hybrid connection surface can be snap joined.

As a further example, where snap connectors are distributed with even or uniform spacing on a circle or where snap connectors are distributed on four corners of a square, and where the snap connectors are on opposite sides of a plane of symmetry, and the snap connectors on opposite sides of a plane of symmetry are of opposite mating genders, a pair of identical hybrid connection surface can be snap joined.

When on opposite sides of a plane of symmetry are of opposite mating genders, the identical hybrid first connection surfaces can be snap connected. For example, where the building blocks 110 and 130 have identical hybrid connection surfaces snap connectors are distributed with even or uniform spacing on a circle or where snap connectors are distributed on four corners of a square, a pair of identical hybrid connection surface can be snap joined.

The first module 10A is to cooperate with the second module 10B to form the example assembly 10 in which the first module 10A and the second module 10B are relatively rotatable about a rotation axis X-X'. The rotation axis is also a center axis of the assembly in this example such that the assembly 10 is axis symmetry about the rotation axis.

The second module 10B comprises a main body having a first axial end 162, a second axial end 164 and a peripheral portion 166 interconnecting the first axial end and the second axial end, as depicted in FIGS. 1D, 1D1 and 1D2.

The peripheral portion 166 includes a peripheral wall extending in a peripheral direction and following a circular path having a center axis which is coaxial with the center axis X-X' of the first module 10A. The peripheral wall has an inner peripheral surface 166A and an outer peripheral surface 166B surrounding the inner peripheral surface. Each of the inner peripheral surface and the outer peripheral surface is a cylindrical surface of cylinder having the center axis as the cylindrical axis and the radial separation distance between the inner peripheral surface and the outer peripheral surface defines a radial thickness of the peripheral wall. The peripheral wall has a substantial uniform radial thickness along the axial direction except at the second retention portion. The peripheral wall has an axial extent, measured in an axial direction along the center axis, which is comparable to the axial extent of the first module 10A. The axial extent defines the width of the peripheral wall.

The second module 10B comprises a second retention portion which is formed on the peripheral wall. The second retention portion has a second retention profile which is characteristic of the second retention portion. The second retention profile is matched and complementary to the first retention profile of the first retention portion of the first module 10A to facilitate relative rotation between the first module and the second module about a rotation axis which is coaxial with the center axis of the second module or at a small angular deviation to the center axis X-X'.

In this example, the retention means is a peripheral protrusion which extends continuously along the inner peripheral surface of the peripheral wall in a peripheral direction to define a protrusion plane which is orthogonal to the center axis, the peripheral direction being a tangential direction to the circle defining the circular peripheral wall.

The peripheral protrusion comprises a peripherally extending rib 168 which projects from the inner peripheral surface and extends radially inwards towards the center axis.

Referring to FIG. 1D1, the inner periphery of the rib 168 defines a circular inner aperture. The inner aperture defines a maximum radial clearance extent of the second module 10B, and the maximum radial clearance extent is slightly larger than the radial extent of the first module 10A at the joining plane, the radial extent being a lateral extent defined by an axial plane containing the center axis as shown in FIG. 1D2.

Referring to FIG. 1D2, the example retention profile of the rib 168 as an example of the second retention portion is in the form of a radial protrusion. The example protrusion is a tapered protrusion which tapers to narrow as the protrusion extends radially inwards towards the rotation axis and has a rounded protrusion end at its innermost radial end. As the protrusion is tapered, the axial extent (with respect to the rotation axis) of the protrusion decreases as it extends inwardly towards the rotation axis. In this example, the retention profile proximal the rotation axis follows a convex curve which is symmetrical about a radial dividing plane.

With a round retention profile, for example, a rounded retention profile or a curved retention profile which is matched and complementary with the rounded profile of the first retention portion while having a small gap with a tightly controlled tolerance, inter-module friction will be reduced and relative rotatability improved. In some embodiments, the protrusion may have a non-rounded profile, for example, an angular profile defined by some sides of a polygon without loss of generality. To enhance relative rotatability, the exterior surface of the second retention portion may be polished and/or coated with PTE to form a low friction surface. In this example, the man body is integrally molded of a low friction thermoplastic such as ABS or PC.

To form the assembly, a user may insert the first building block 110 into the second module 10B, for example, by inserting the first surface 112 of the first building block 110 into a first access aperture on the first axial end 162 of the second module 10B; to insert the second building block 130 into the second module 10B, for example, by inserting the first surface 132 of the second building block 130 into a second access aperture on the second axial end 164 of the second module 10B with the first connection means and the second alignment means aligned. By pressing the aligned first and second building blocks axially against each other while the connection means aligned, the first building block 110 and the second building block 130 are snap connected to form the example building block assembly 10A.

The assembly may be connected to an outside structure by means of the connections means 117, 137 on one second surface or both second surfaces of the first and second building blocks. When the assembly is so connected and the outside structure is not rotatable, the second module 10B will rotate relative to the outside structure about the rotation axis when the non-rotating outside structure slides on a frictional surface. When the assembly is connected to an outside structure which is rotatable about the rotation axis of the assembly, with the second module 10B fixed or held on a frictional surface, the outside structure, for example, a wheel axle, will rotate relative to the second module 10B when the outside structure rotates about the rotation axis.

In this example, the second module has an overall shape of a rubber tyre of a road vehicle so that the assembly resembles the overall impression of a wheel of the vehicle.

When the first module 10A and the second module 10B are in relative rotation with the center axis as the rotation axis, the peripherally extending rib on the second module will slide along and guided by the peripherally extending channel of the first module. In operation, the peripherally extending channel resembles a bearing race and the peripherally extending rib resembles blade bearing or bearing blade.

The example second module 10B is integrally formed as a single piece. In some embodiments, the second module may comprise a first building block and a second building block which are stacked to join at a connection plane CP-CP', as depicted in FIG. 1D3. When the second module is formed from discrete building blocks, the first module can be an integral module or can comprise discrete block.

A first module 10A1 can be formed by stacking the first building block 110 and the second building block 130 in a different manner. In this example configuration, the surface 113 of the first building block 110 is in abutment with the surface 133 of the second building block 130, as depicted in FIG. 1CB. When in this configuration, the axial orientations of the building blocks 110 and 130 are reversed and then stacked to form the first module 10A1. With this reversal in orientation, the following descriptions in relation to the assembly 10 will be incorporated herein and applied mutatis mutandis. For example, the surface 113 of the first building block 110 will be referred to as the first connection surface, the connection means on the surface 113 will be referred to as the first connection means and internal connection means, and the first connection means comprises a plurality of snap connectors so that the surface 113 is a snap connection surface. Consequently, the surface 112 of the first building block 110 will be referred to as the second connection surface, the connection means on the surface 112 will be referred as the second connection means and external connection means, and the second connection means may or may not be snap connectors. Likewise, the surface 133 of the second building block 130 will be referred to as the first connection surface, the connection means on the surface 133 will be referred to as the first connection means and internal connection means, and the first connection means comprises a plurality of snap connectors so that the surface 133 is a snap connection surface. Consequently, the surface 132 of the second building block 130 will be referred to as the second connection surface, the connection means on the surface 132 will be referred as the second connection means and external connection means, and the second connection means may or may not be snap connectors.

Referring to FIG. 1CB, the example first module 10A1 has a first axial end defined by the surface 132 of the second building block 130, a second axial end defined by the surface 112 of the first building block 110 and a peripheral portion extending between the first axial end and the second axial end and defined by the first retention means. The exterior peripheral surface of the peripheral portion defines a first retention surface of the first retention portion. The radial profile of the first retention surface is a combination radial profile formed by a stacked combination of the radial profiles of the first partial peripheral retention portions of the building blocks 130, 110.

The first retention portion is to cooperate with a second retention portion of a corresponding second module to retain or maintain the first module 10A1 and the corresponding second module in an interlocked but relatively rotatable relationship.

The first retention portion has a first retention profile in a radial direction, the radial direction being with respect to the rotation axis, and the second retention portion has a second retention profile in the radial direction. The first retention profile and the second retention profile are complementary profiles which cooperate to restrain or resist relative movement between the first module and the second module in the axial direction or to contain the relative movement within a tight tolerance while permitting relative rotation between the first module and the second module in the rotation direction. To facilitate rotatable retention in the aforesaid manner, that is to maintain the modules in interlocked relationship while permitting relative rotation in the rotation plane, the modules are slightly in a loose fit with a peripheral gap with a very tight tolerance.

Likewise. the first retention portion of the example first module 10A1 is a peripherally extending retention means for retaining a corresponding matched second module. The first retention portion is formed by stacked connection of the corresponding partial peripheral retention portions of the component building blocks 110, 130, with the corresponding first connection surfaces of the component building blocks in abutment contact.

Referring to FIG. 1CB, the first retention portion of the module 10A1 comprises a peripherally extending rib, or a peripheral rib in short. The peripheral rib is an elongate ridge that extends radially with respect to the rotation axis and peripherally along a radial plane in a peripheral direction which is orthogonal to the rotation axis to surround the smaller one of the first surface and the second surface, the peripheral direction being orthogonal to the rotation axis.

The first retention portion has a characteristic retention profile and the retention profile of the first retention portion of the first module 10A1 is in the form of a radial protrusion. The example protrusion is a tapered protrusion which tapers to narrow as the protrusion extends radially outwards and away from the axial ends of the building block from which the protrusion begins. The tapered protrusion ends at the outermost radial end of the retention means where a flat end is formed. The axial extent (with respect to the rotation axis) of the protrusion decreases as it extends outwards away from the rotation axis.

The retention profile of the protrusion in the radial direction is shown in FIG. 1CB. Referring to FIG. 1CB, the protrusion follows a concave curve to taper to narrow as it extends radially outwards away from the axial ends and towards the connection plane of the first module 10A1. The concave curves due to the partial peripheral retention portions of the building blocks 110, 130 stop at the outermost radial end of the protrusion where a flat peripheral rim having an axial thickness is formed. The rim has an axial thickness comparable to the combined axial extents of the panel portions of the component building blocks. The retention profile of the first retention portion has a mirror symmetry about the connection plane. In this example, the retention portion has a non-rounded end at its radial ends. In some embodiments, radial ends may be rounded ends without loss of generality.

An example corresponding second module suitable for cooperating with the example first module 10A1 would be similar to that of module 10B, except that the peripherally extending rib 168 is to be replaced by a peripherally extending channel. With the replacement of the peripherally extending rib by a peripherally extending channel, the radial thickness of the second module at its axial ends will be substantially larger than that of the module 10A to accommodate the radial extent of the channel. While the maximum radial extent of the module 10A is defined by the retention means, and more particularly the outer periphery of the peripherally extending channel 168, the maximum radial extent of the module 10A1 is defined by the radial extent of the peripheral rib of the module 10A1.

The peripherally extending channel is devised to have a radial profile which is substantially matched with the radial profile of the protrusion of the first retention portion to retain or maintain the first module 10A1 and the corresponding second module in an interlocked but relatively rotatable relationship as described hereinbefore. To facilitate rotatable retention in the aforesaid manner, the first module 10A1 and the corresponding second module 10B are somewhat loosely fitted together so that a small gap is present between the first retention portion and the second retention portion, as described hereinabove, and the related description is incorporated by reference and to apply mutatis mutandis.

When the first module 10A1 and the corresponding second module are in relative rotation with the center axis as the rotation axis, the peripherally extending rib on the first module 10A will slide along and guided by the peripherally extending channel of the second module. In operation, the peripherally extending channel is a continuous channel resembling a bearing race and the peripherally extending rib resembles and functions as a blade bearing or a bearing blade.

The peripheral extending rib of the example modules 10A1, 10B is a continuous rib extending in the peripheral direction to cooperate with the continuous peripheral extending channel on a corresponding module to facilitate guided relative rotation in a rotation plane. In some embodiments, a plurality of discrete protrusions is formed as a retention portion to replace the continuous rib so that the second module comprises a second retention portion having discrete retention members distributed along the connection plane, which is also a retention plane.

An example second module 10B1 which is matched with a corresponding first module having a continuous peripheral extending channel such as a first module of the same type as the first module 10A is depicted in FIG. 1E. The second module 10B1 comprises a main body having a first axial end, a second axial end and a peripheral portion interconnecting the first axial end and the second axial end. The peripheral portion includes a peripheral wall extending in a peripheral direction and following a circular path having a center axis which is coaxial with the center axis of the first module. The peripheral wall has an inner peripheral surface 168A1 and an outer peripheral surface 166B1 surrounding the inner peripheral surface. As the second module 10B1 is substantially identical in description to that of module 10B except for the replacement of the continuous rib by a plurality of discrete protrusions, the description in relation thereto is incorporated herein and to apply mutatis mutandis.

The example protuberance 1681 is an axis symmetrical protrusion having a circular base which is integrally formed on the inner peripheral surface of the peripheral and a rounded top, the axis of symmetry being a center axis which passes through the circular base and intersects the rotation axis. The protuberance 1681 is a tapered protrusion which projects radially from the circular base and extends radially towards the rotation axis and having a retention profile which substantially matches, (that is, slightly loosely matches or matches with a small clearance), the retention profile of the first retention portion of a corresponding first module to facilitate retention and relative rotation in the aforesaid manner. Optionally, the protuberances 1681 are evenly distributed along the inner peripheral surface 168A1, with the center axes of the protuberances 1681 aligned in a radial plane which is preferably a radial plane of symmetry of the main body of the second module.

Likewise, the continuous rib of the first module 10A1 may be replaced by a plurality of discrete protrusions in a similar manner to form a first module having a first retention portion comprising protuberances similar to the protuberance 1681 without loss of generality.

A protuberance of a first retention portion or a second retention portion may not be axis symmetrical. For example, the protuberance may have a uniform retention profile in the peripheral direction without loss of generality. In the example of assemblies built from the first module 1010A1, 10B, the protuberance has a tapered radial profile. In some embodiments, the radial profile can be flared.

An example building block assembly 20 depicted in FIG. 2 comprises a first module 20A and a second module 20B which are releasably fastened to form the assembly 20. The first module 20A and the second module 20B are relatively rotatable about a rotation axis X2-X2'. The first module 20A and the second module 20B are retained in the retention state by a retention means. When in the retention state, the first module 20A and the second module 20B are interlocked and maintained as a single assembly, with the first module 20A and the second module 20B relatively rotatable about the rotation axis X2-X2'.

The first module 20A comprises a first axial end, a second axial end and a peripheral portion interconnecting the first axial end and the second axial end, as shown in FIGS. 2B, 2B1 and 2B2. The first module 20A comprises a first building block 210 and a second building block 230 which are snap fastened and joined on a connection plane. The first module 20A is substantially identical to the module 10A and the description on and in relation to the module 10A is incorporated herein by reference.

The second module 20B comprises a first building block 260, a second building block 280 which are snap fastened and joined on a connection plane, and a plurality of bearing balls which is trapped on the second module 20B.

The second module 20B comprises a first axial end, a second axial end and a peripheral portion interconnecting the first axial end and the second axial end, as shown in FIG. 2C. The peripheral portion of the second module 20B includes an inner peripheral wall 254, an outer peripheral wall 255, and an intermediate peripheral portion extending between the inner peripheral wall and the outer peripheral wall. The inner peripheral wall is cylindrical and defines a cylindrical bore having a bore axis which is aligned with the rotation axis. A plurality of ball receptacles is formed on the intermediate peripheral portion and each ball receptacle has a ball receptacle aperture on the inner peripheral wall.

The first module 20A has a radial extent which is just slightly smaller than the radial extent of the cylindrical bore of the second module 20B. The radial extent of the first module 20A is just slightly smaller than the radial extent of the cylindrical bore such that the first module 20A can pass through the cylindrical ball while in close abutment with the cylindrical bore.

A plurality of bearing balls 500 is retained on the second module 20B. The plurality of bearing balls is retained by a corresponding plurality of ball receptacles 258 in the intermediate peripheral portion. Each bearing ball seats on the ball receptacle 258 and is freely rotatable relative to the ball receptacle and relative to the second module. An example bearing ball is made of steel, ABS or PC (polycarbonate). A major portion of the bearing ball is retained inside the intermediate peripheral portion. A minor portion of the bearing ball is outside the ball receptacle and protrudes outside the intermediate peripheral portion through the ball receptacle aperture. The portion of the bearing ball which protrudes outside the intermediate peripheral portion of the second module 20B is exposed and projects radially inwards from the inner peripheral wall 254 and extends radially inwards towards the rotation axis. The bearing ball is freely rotatable to facilitate low-friction relative rotation between the first module 20A and the second module 20B. In some embodiments, the bearing balls may be non-rotatable relative to the ball receptacle and/or the second module. The plurality of bearing balls forms a second retention portion of the building block assembly 20.

The first building block 260 of the second module 20B comprises a main body having a first surface 262, a second surface 263, an intermediate peripheral portion defined between an inner peripheral wall 264 and an outer peripheral wall 265. Each of the inner peripheral wall 264 and the outer peripheral wall 265 extends between the first surface 262 and the second surface 263. The inner peripheral wall 264 extends along a circular track with the rotation axis as center of the circular track. The outer peripheral wall 265 is concentric with the inner peripheral wall 264 and extends along a circular track to surround the inner peripheral wall 264.

A plurality of snap connectors 266 is formed on the first surface 262 of the first building block 260 to form a first connection means and define a first connection surface of the first building block 260. The snap connectors 266 are distributed along a circular track with equal or uniform spacing between adjacent snap connectors 266, this circular track being concentric with the inner peripheral wall 264. The snap connectors 266 are located about half-way between the inner peripheral wall 264 and the outer peripheral wall 265.

Each snap connector 266 comprises a connection portion having a coupling axis which is characteristic of the connection portion. The connection portion comprises an engagement portion having mechanical mating features for entering into snap engagement with a corresponding engagement portion of a matched corresponding connector. The first connection means of the first connection surface defines a connection direction along which the first connection means is to enter into snap engagement with a corresponding engagement means on a corresponding connection surface of a matched corresponding connector.

A plurality of partial ball receptacles 268 is formed on the inner peripheral wall 264. Each partial ball receptacle 268 is an indentation formed on the intermediate peripheral portion of the first building block 260. The indentation is formed as a recess or a cutout which extends between the first surface 262 and the inner peripheral wall 264. Each indentation is defined by a receptacle wall having a partial spherical surface for receiving a spherical ball to define the shape of the partial ball receptacle. The receptacle wall forms a first receptacle aperture on the first surface and a second receptacle aperture on the inner peripheral wall. The partial ball receptacle 268 is shaped and sized to receive a bearing ball such that when the bearing ball is received, a major portion of the bearing ball is inside the intermediate peripheral portion while a minor portion of the bearing ball is outside the intermediate peripheral portion and projects away from the inner periphery surface, with the bearing ball freely rotatable. In general, the partial ball receptacle 268 defines a receptacle for receiving a half spherical segment having a segment height larger than the spherical radius, with a bisection defining the half spherical segment approximately on the first surface 262. The partial ball receptacles are optionally distributed at a uniform spacing to promotion axis evenness and balance of the assembly. A partial ball receptacle is an example of a peripheral formation on the peripheral wall of the building block.

The second building block 280 comprises a main body having a first surface 282, a second surface 283, an inner peripheral wall 284 and an outer peripheral wall 285. Each of the inner peripheral wall 284 and the outer peripheral wall 285 extends between the first surface 282 and the second surface 284 to define an intermediate peripheral portion 287. The inner peripheral wall 284 extends along a circular track with the rotation axis as center of the circular track and defines an inner aperture. Similar to the corresponding embodiments, the inner aperture is circular and defines a maximum radial clearance extent of the second module 20B. This maximum radial clearance extent is slightly larger than the radial extent of the first module 20A so that the first module can be mounted and retained inside the second module 20B with the first module 20A and the second module 20B relatively rotatable.

The outer peripheral wall 285 is concentric with the inner peripheral wall 284 and extends along a circular track to surround the inner peripheral wall 284.

A plurality of snap connectors 286 is formed on the first surface 282 of the second building block 280 to form a first connection means and define a first connection surface of the second building block 280. Each snap connector 286 has a connection portion having a characteristic coupling and an engagement portion having mechanical mating features characteristic of the connection portion. The first connection means of the second building block 280 is a matched counterpart connection means of the first connection means of the first building block 260 and are snap engageable to form a pair of snap engaged first connection means.

The snap connectors 286 on the first connection surface 282 of the second building block 280 are distributed to correspond to the distribution of the snap connectors 266 on the first connection surface 262 of the first building block 260, and snap fasteners 266, 286 forming a pair of corresponding snap fasteners are coupling axes aligned with snap engageable engagement portions.

The second surface 283 is the top surface of a panel portion having a top surface and a bottom surface which is underneath the top surface on an opposite axial side of the panel portion. The portion of this building block between the inner peripheral wall 284 and the bottom surface of the panel portion forms an internal compartment. The plurality of snap connectors 286 projects from axially downwards from the bottom surface of the panel portion and extend axially towards the first connection surface 282.

A plurality of partial ball receptacles 288 is formed on the inner peripheral wall 284. The inner peripheral wall 284 is formed as a receptacle shelf on which the plurality of partial ball receptacles 288 is formed. The inner peripheral wall 284 is part of a shell wall which projects away from the bottom surface of the panel portion and extends axially towards the first connection surface 282. The plurality of partial ball receptacles is integrally formed as a corresponding plurality of ball receptacle indentations on the shell wall. The shell wall flares to widen as it extends away from the second surface 283 to define the partial ball receptacles. Likewise, the ball receptacles are shaped and dimensioned so that a minor portion of a bearing ball is exposed to a bore passing through the inner aperture defined by the inner peripheral wall 284. The shell wall thickness is optionally uniform and the shell wall follows a rippled profile as it extends in a peripheral direction to surround the inner aperture of the building block 280. The shell wall is a continuous wall in this example, but can be optionally non-continuous or broken. The substantially hollow building block results in a lower weight compared to the embodiments where the partial ball receptacles are formed as cutouts on a solid intermediate peripheral portion. This shell construction can be applied in place of the solid cutout option and vice versa without loss of generality.

Likewise, each partial ball receptacle is an indentation formed on the intermediate peripheral portion 284. The indentation is formed as a recess which extends between the first surface 282 and the inner peripheral wall 284. The partial ball receptacle 288 has the same features and characteristics of the partial ball receptacle 268, and the description in relation of the partial ball receptacle 268 is incorporated herein and to apply mutatis mutandis to the partial ball receptacle 288 for succinctness. The partial ball receptacles 288 of the second building block 280 are distributed to correspond to the distribution of the partial ball receptacles 268 of the first building block 260 and have a manner of distribution which is the same or similar as that of the partial ball receptacles 268, and the manner of distribution of the partial ball receptacles 268 is incorporated herein and to apply mutatis mutandis to the distribution of the partial ball receptacles 288. The first building block 260 and the second building block 280 of the second module 20B are a pair of matched building blocks having matched first connection surfaces and matched first connection means that are snap connectable. When the matched building blocks 260, 280 are correspondingly aligned and snap connected, the corresponding matched first connection means are in snap engagement, the corresponding matched first connection surfaces are in abutment, the corresponding inner and outer peripheral walls are aligned and in abutment, and the corresponding partial ball receptacles 268, 288 are joined to cooperate to form the ball receptacles.

When the matched building blocks 260, 280 are snap connected with the bearing balls in place and sitting squarely on the plurality of partial ball receptacles 268 or 288, the second module 20B is formed and the bearing balls are retained by the assembled ball receptacles. When in this assembled state, the portions of the bearing balls, that is, the minor portions of the bearing balls which project beyond the inner peripheral wall 258 and which project towards the rotation axis protrude radially inwards from the inner peripheral wall 258, are exposed.

To assemble the building block assembly 20, the first module 20A is placed on a support surface with its first axial end facing upward. The first building block 260 of the second module 20B is then inserted into the first module 20A with its first connection surface 262 facing upwards. As the radial extent of the first module 20A is circular and just slightly smaller than the radial clearance of the cylindrical bore of the first building block 260, the first building block 260 can pass through the first module 20A and rest on the support surface, with the second surface of the first building block 260 flushed with the axial end of the first module 20A which is on the support surface. When the first building block 260 and the first module 20A are so aligned, the first connection surface 262 of the first building block 260 is flush with the first connection surface of the first building block or the connection surface of the first module 20A. When the surfaces are in this flush relationship, the bearing balls are placed on the partial ball receptacles 268. When the bearing balls are stable on the partial ball receptacles 268, the second building block 280 is inserted into the first module 20A, with its first connection surface 282 facing downwards and facing the first surface 262 of the first building block 260, and with their respective center axes aligned. Next, the first connection means on the first connection surfaces of the first 260 and second 280 building blocks are aligned and pressed together while the bearing balls are in place and the building block assembly 20 is formed.

When in this assembled state, the exposed portions of the bearing balls, that is, the portions of the bearing balls which project beyond the inner peripheral wall and project towards the rotation axis will project into the interior of the first module. More specifically, the portions of the bearing balls which project beyond the inner peripheral wall and project towards the rotation axis will project into the interior of the peripheral extending channel the first module 20A.

When in this assembled state, the portions of the bearing balls which project beyond the inner peripheral wall 258 and project into the interior of the peripheral extending channel of the first module 20A collectively define a second retention portion, with the peripheral extending channel of the first module 20A defining a first retention portion. The first retention portion and the second retention portion cooperate to form a retention means which restrains or resists relative movement between the first module and the second module in an axial direction of the rotation axis or to contain the relative movement within a tight tolerance while permitting relative rotation between the first module and the second module in a rotation direction defined by the rotation axis. The retention means also operates to maintain the first module 20A and the second module 20B in the retention state in which the first module and the second module are interlocked.

In alternative embodiments, the ball receptacles are formed on the first module, the bearing balls are retained on the first module, and the peripheral extending groove is correspondingly formed on the second module.

An example building block assembly 30 depicted in FIG. 3 comprises a first module 30A and a second module 30B which are releasably fastened to form the assembly 30. The first module 30A and the second module 30B are relatively rotatable about a rotation axis X3-X3'. The first module 30A and the second module 30B are retained in the retention state by a retention means. When in the retention state, the first module 30A and the second module 30B are interlocked and maintained as a single assembly, with the first module 30A and the second module 30B relatively rotatable about the rotation axis. The first module 30A and the second module 30B have features which are substantially identical to the aforesaid first and second modules and inter-relationships which are substantially identical, descriptions on and in relation to the aforesaid first and second modules are incorporated herein and to apply mutatis mutandis without loss of generality and for the benefit of succinctness. The building block assembly 30 is substantially identical to that of the assembly 20, except that three relatively rotatable modules which are independently rotatable can be concentrically assembled and retained by the same or similar mechanisms and retention means. For example, by having modules 20A retained in the bore.

An example building block module 40 depicted in FIGS. 4A, 4B and 4C comprises a first building block 460 and a second building block 480 which are snap fastened and joined on a connection plane. The first building block 460 comprises a main body having a first surface 462, a second surface 463 and a peripheral surface 465 extending between the first surface and the second surface. The second building block 480 comprises a main body having a first surface 482, a second surface 483 and a peripheral surface 485 extending between the first surface and the second surface.

Apart from having radially projecting teeth on the outer peripheral walls, and that the outer peripheral walls have different radial extents, the first building block 460 and the second building block 480 have features which are substantially identical to the aforesaid first building block 260 and the aforesaid building block 280 and substantially identical inter-relationships, descriptions on and in relation to the aforesaid first and second building blocks and their relationship are incorporated herein and to apply mutatis mutandis without loss of generality and for the benefit of succinctness.

An example building block assembly 50 depicted in Figures Sand 5A comprises a first module 50A and a second module 50B which are releasably fastened to form the assembly 50.

The first module 50A and the second module 50B are relatively rotatable about a rotation axis. The first module 50A and the second module 50B are retained in the retention state by a retention means. When in the retention state, the first module 50A and the second module 50B are interlocked and maintained as a single assembly, with the first module 50A and the second module 50B relatively rotatable about the rotation axis.

The first module 50A comprises a first axial end, a second axial end and a peripheral portion interconnecting the first axial end and the second axial end. The first module 50A is substantially identical to the module 10A and the description on and in relation to the module 10A is incorporated herein by reference.

The second module 50B comprises a first building block 560, a second building block 580 which are snap fastened and joined on a connection plane, and a plurality of bearing balls which is trapped on the second module 50B. In addition, a plurality of bear ball receptacles 590 is formed on an exterior periphery of the second module 50B. The ball receptacle 590 is formed by combining a partial bear ball receptacle 568A on the building block 560 and a corresponding partial bear ball receptacle 588A on the building block 580. In this assembly 50, the building block connectors 566, 588 are the same type as those of the module 10A, that is, flat headed building block connectors 566, 588. Otherwise, the second module 50B is identical in description to module 20B and the description on and in relation to module 20B is incorporated herein reference and to apply mutatis mutandis to the module 50B unless the context requires otherwise, with reference numerals increased by 300 where appropriate or necessary.

While the disclosure has made reference to various embodiments, the embodiments are as examples and should not be used to restrict the scope of the disclosure.

For example, while the example assemblies are toy block assemblies for construction of toy wheels, toy gears, toy teethed wheel assemblies, the assemblies can be used to build other toy assemblies or non-toy assemblies.

When used for toy applications as toy assemblies, the component building blocks have a typical radial extent (or width, or lateral extent) of between 1 cm and 15 cm and a typical axial extent (or thickness) or between 0.3 mm for a miniature block to 8 cm for what is called a mega block. For example, the radial extent can be, in units of cm, 1 for a miniature block, 1, 1.5, 2, 2.5, 3.5, 4, 4.5, 5, 5.5, 6, 6.5, 7, 7.5, 8, 8.5, 9, 9.5, 10, 10.5, 11, 11.5, 12, 12.5, 13.5, 14, 14.5, 15, 15.5, 16, 16.5, 17, 17.5, 18, 18.5, 19, 19.5, 20, or more for a mega block, or a range or any ranges formed by a selected combination of any of the aforesaid values as limits of a range or limits of ranges. For example, the axial extent can be, in units of cm, 1 for a miniature block, 1, 1.5, 2, 2.5, 3.5, 4, 4.5, 5, 5.5, 6, 6.5, 7, 7.5, 8, 8.5, 9, 9.5, 10, or more for a mega block, or a range or any ranges formed by a selected combination of any of the aforesaid values as limits of a range or limits of ranges.

When in toy applications, the component building blocks and/or their parts or components are made of ABS, PC, or other suitable strong thermoplastics having a high rigidity and a small degree of resilience to be slightly resiliently deformable to facilitate press-fit or snap-fit engagement.

When for industrial uses, for example for modular construction of machines, buildings, structures, parts, the aforesaid values may be scaled up, in unit of times, by 10, 20, 30, 40, 50, 60, 70, 80, 90, 100, 110, 120, or a range or any ranges formed by a selected combination of any of the aforesaid values as limits of a range or limits of ranges; and the component building blocks may be made of strong thermoplastics, carbon fibers, fiber glass, or metals, or other moldable materials, having a high rigidity and a small degree of resilience.

While assemblies of the building blocks have been described with reference to snap engagement or snap connection and snap connectors, the building blocks may be joined or connected by other press-fit mechanisms or methods without loss of generality where possible.

While the disclosure has made reference to various embodiments, the embodiments are for example and should not be used to limit restrict the scope of the disclosure.

For example, the example building blocks herein are toy building blocks for toy or toy-like applications and the building block assemblies are toy or toy-like building block assemblies. However, the building blocks herein can also be non-toy building blocks such as machine building blocks, construction building blocks such as tiles or bricks, and/or other industrial building blocks and the building block assemblies are modular built machines or machine parts, modular built structures, modular built structure parts, modular built structural parts, modular built fixture and/or fixture parts and/or fixture sub-assemblies.

When used for toy applications as toy assemblies, the component building blocks have a typical radial extent (or width, or lateral extent) of between 1 cm and 15 cm and a typical axial extent (or thickness) or between 0.3 mm for a miniature block to 5 cm. For example, the radial extent can be, in units of cm, 1 for a miniature block, 1, 1.5, 2, 2.5, 3.5, 4, 4.5, 5, 5.5, 6, 6.5, 7, 7.5, 8, 8.5, 9, 9.5, 10, 10.5, 11, 11.5, 12, 12.5, 13.5, 14, 14.5, 15, 15.5, 16, 16.5, 17, 17.5, 18, 18.5, 19, 19.5, 20, or more for a mega block, or a range or any ranges formed by a selected combination of any of the aforesaid values as limits of a range or limits of ranges. For example, the axial extent can be, in units of cm, 1 for a miniature block, 1, 1.5, 2, 2.5, 3.5, 4, 4.5, 5, 5.5, 6, 6.5, 7, 7.5, 8, 8.5, 9, 9.5, 10, or more for a mega block, or a range or any ranges formed by a selected combination of any of the aforesaid values as limits of a range or limits of ranges.

When for industrial uses, for example for modular construction of machines, buildings, structures, parts, the aforesaid values may be scaled up, in unit of times, by 10, 20, 30, 40, 50, 60, 70, 80, 90, 100, 110, 120, or a range or any ranges formed by a selected combination of any of the aforesaid values as limits of a range or limits of ranges; and the component building blocks may be made of strong thermoplastics, carbon fibres, fibre glass, or metals, or other mouldable materials, having a high rigidity and a small degree of resilience.

While assemblies of the building blocks have been described with reference to snap engagement or snap connection and snap connectors, the building blocks may be joined or connected by other press-fit mechanisms or methods without loss of generality.

While the example connectors described and depicted herein are snap connectors adapted for making snap-fit engagement, a connector herein can be a "press-fit" connector for making press-fit engagement or a "friction-fit for making press-fit engagement unless the context requires otherwise.

In general, a snap-fit connector comprises an engagement portion having snap-fit mating features. The terms "snap", "snap fit", and "snap-fit", are interchangeably used herein unless the context requires otherwise. The terms "fastener" and "connector" are also interchangeably used herein unless the context requires otherwise. In this description and specification, and when in relation to a connector or an engagement portion having a coupling axis, the terms "closely-fitted engagement" and "coupled engagement" are interchangeable, the axial direction is with respect to the coupling axis and the axial direction is along the coupling axis, and the radial direction is with respect to the coupling axis and the radial extent is in the radial direction, unless the context requires otherwise.

The words "first", "second", "third", "fourth", etc. are generic terms for ease of reference only and are not intended for indicate priority, order or sequence unless the context requires otherwise or specifies otherwise. Where there are conflicts in relation to the aforesaid generic terms, the conflicts are to resolve to give a meaning which is reasonable for interpretation where possible.

While singular and plural terms are used herein, a singular term may apply mutatis mutandis to a plural situation and a plural term may apply mutatis mutandis to a single situation where the context permits or requires.

Table of numerals

| | | | |
|---|---|---|---|
| 10 | Building block assembly | | |
| 10A | First module | 10B | Second module 10A |
| 110 | First building block | 130 | second building block |
| 112 | First surface (first connection surface) | 132 | First surface |
| 113 | Second surface | 133 | Second surface |
| 114 | Peripheral surface | 134 | Peripheral surface |
| 116 | Connector | 136 | Connector |
| 117 | Connector | 137 | Connector |
| 118 | First partial peripheral retention portion | 138 | Second partial peripheral retention portion |
| 119 | Outer peripheral edge of retention portion | 166A | Inner peripheral surface |
| 168 | Peripherally extending rib | X1-X1' | Center axis |
| 168A1 | Inner peripheral surface | X2-X2' | Center axis |
| 10A | First module | 20B | Second module |
| 210 | First building block of first module | 260 | First building block of second module |
| 230 | Second building block of first module | 280 | second building block of second module |
| 266 | Snap connector on first surface | 258 | Inner peripheral wall |
| 500 | Bearing ball | 285 | Outer peripheral wall |
| 260 | First building block of second module | 263 | Second surface of first building block |
| 262 | First surface of first building block | 264 | Inner peripheral wall of first building block |

The invention claimed is:

1. A building block assembly comprising a first module and a second module which are relatively rotatable about a rotation axis which defines an axial direction, wherein the first module is a building block module comprising a first building block and a second building block which are snap fastened to form a building block stack, wherein the first building block comprises a first connection surface, a plurality of snap connectors on the first connection surface, and a first peripheral surface extending around the first connection surface and surrounding the rotation axis; and the second building block comprises a second connection surface, a plurality of snap connectors on the second connection surface, and a second peripheral surface extending around the second connection surface and surrounding the rotation axis;

wherein the building block stack is mechanically retained by the second module upon snap fastening of the first building block and the second building block in a connection direction defined by a connection axis which is coaxial with the rotation axis;

wherein the first connection surface of the first building block and the second connection surface of the second building block are in abutment contact at a connection plane when the first building block and the second building block are in snap-fit connection;

wherein a gap is present between the building block stack and the second module to facilitate relative rotation between the first module and the second module about the rotation axis;

wherein the first module comprises a first retention portion having a first retention profile extending in a radial direction with respect to the rotation axis and the second module comprises a second retention portion having a second retention profile extending in the radial direction, and wherein the first retention portion and the second retention portion cooperate to form a retention means to contain relative axial movement between the first module and the second module in the axial direction within a tight tolerance while permitting relative rotation between the first module and the second module about the rotation axis; and wherein the first peripheral surface of the first building block defines a first partial retention portion, the second peripheral surface of the second building block defines a second partial retention portion on the second building block, and the first peripheral surface and the second peripheral surface cooperate to define the first retention portion and the first retention profile; and wherein the first partial retention portion and the second partial retention portion are stacked in a stacking direction along a stacking axis to form the first retention portion, the stacking axis being aligned with the rotation axis.

2. The building block assembly of claim 1, wherein the first module has axial ends and a first peripheral wall interconnecting the axial ends, wherein the first peripheral wall has an outer peripheral surface which is formed by the first peripheral surface and the second peripheral surface axially combined; wherein the second module has axial ends and a second peripheral wall interconnecting the axial ends, wherein the first retention portion has a first retention profile formed on the first peripheral wall, and the second retention portion has a second retention profile formed on the second peripheral wall, the second retention profile being complementary to the first retention profile.

3. The building block assembly of claim 2, wherein the axial ends of the first module comprise a first axial end having a first end surface and a second axial end having a second end surface, wherein a plurality of snap connectors are distributed on at least one of the first end surface or the second end surface, and wherein the snap connectors are distributed along a circular track and surround the rotation axis.

4. The building block assembly of claim 3, wherein the snap connectors are ball-shaped connectors.

5. The building block assembly of claim 3, wherein the second module comprises an inner peripheral wall, a cylindrical bore defined by the inner peripheral wall, and an outer peripheral wall surrounding the inner peripheral wall; and wherein a plurality of ball receptacles for receiving bearing balls is formed on the inner peripheral wall.

6. The building block assembly of claim 5, wherein the second module comprises a third building block and a fourth building block which are snap fastened to form a building block assembly, and wherein each one of the third building block and the fourth building block has a main body defining a cylindrical bore which is coaxial with the rotation axis.

7. The building block assembly of claim 6, wherein the second module surrounds the first module, wherein the first module comprises a main body having a circular inner aperture, and wherein a building block of the second module comprises a main body comprising a main panel having a top panel surface and bottom panel surface, an outer peripheral wall surrounding the main panel, a plurality of snap connectors formed on the top panel surface and a plurality of snap connectors formed on the bottom surface.

8. The building block assembly of claim 7, wherein the building blocks forming the first module and the second module are made of a rigid material, and wherein the first module and the second module are in loose fit.

9. The building block assembly of claim 3, wherein the second module comprises an inner peripheral wall, a cylindrical bore defined by the inner peripheral wall, and an outer peripheral wall surrounding the inner peripheral wall; and wherein a plurality of ball receptacles for receiving bearing balls is formed on the outer peripheral wall.

10. The building block assembly of claim 1, wherein the first building block comprises a second connection surface, a plurality of snap connectors on the second connection surface, and the first peripheral surface surrounding the plurality of snap connectors on the second connection surface.

11. The building block assembly of claim 1, wherein the first module has a first axial end, a second axial end, and a first peripheral wall interconnecting the first and second axial ends, and wherein a plurality of snap connectors are formed on one or both of the axial ends.

12. A building block assembly comprising a first module and a second module which are relatively rotatable about a rotation axis which defines an axial direction, wherein the first module is a building block module comprising a first building block and a second building block which are snap fastened to form a building block stack, wherein the building block stack is mechanically retained by the second module upon snap fastening of the first building block and the second building block in a connection direction defined by a connection axis which is coaxial with the rotation axis, wherein a gap is present between the building block stack and the second module to facilitate relative rotation between the first module and the second module about the rotation axis;

wherein the first module comprises a first retention portion having a first retention profile extending in a radial direction with respect to the rotation axis and the second module comprises a second retention portion having a second retention profile extending in the radial direction, and wherein the first retention portion and the second retention portion cooperate to form a retention means to contain relative axial movement between the first module and the second module in the axial direction within a tight tolerance while permitting relative rotation between the first module and the second module about the rotation axis;

wherein the first retention portion comprises a first partial retention portion on the first building block and a second partial retention portion on the second building block, and wherein the first partial retention portion and the second partial retention portion are stacked in a stacking direction along a stacking axis to form the first retention portion, the stacking axis being aligned with the rotation axis; and wherein the second module has a first end surface on a first axial end, a second end surface on a second axial end, and a peripheral portion interconnecting the first axial end and the second axial end; wherein the peripheral portion comprises a peripheral wall having an inner peripheral surface and the second retention portion of the second module projects radially inwards from the inner peripheral surface and extends towards the rotation axis to define the second retention portion of the second module.

13. The building block assembly of claim 12, wherein the second retention portion of the second module defines a plane of protrusion which is orthogonal to the rotation axis, wherein the first retention portion of the first module comprises a peripherally expending channel which extends in a peripheral direction to surround the rotation axis, and wherein the channel and the protrusion are matched.

14. The building block assembly of claim 13, wherein the second retention portion comprises a peripherally extending rib projecting from the inner peripheral surface and extending radially inwards towards the rotation axis.

15. The building block assembly of claim 13, wherein the second retention portion comprises a plurality of protuberances and the protuberances are distributed along the inner peripheral surface and extend radially inwards to define a protrusion plane.

16. The building block assembly of claim 15, wherein each of the plurality of protuberances is an axis-symmetrical protrusion having a circular base and an axis of symmetry, wherein the axis of symmetry is a center axis passing through the circular base; and wherein the center axes of the plurality of protuberances cooperate to define a plane of symmetry of the second module.

17. The building block assembly of claim 12, wherein the second retention portion has a retention profile, and the retention profile has a maximum radial extent; and wherein the gap between the second module and the building block stack of the first module has a width which is between 1% and 5% of the maximum radial extent.

18. The building block assembly of claim 12, wherein a plurality of snap connectors is formed on at least one of the first end surface or the second end surface, and wherein the snap connectors are distributed in a circular track coaxial with and surrounding the rotation axis.

19. The building block assembly of claim 18, wherein the snap connectors on an end surface of the second module are distributed at uniform spacing.

20. A building block assembly comprising a first module and a second module which are relatively rotatable about a rotation axis which defines an axial direction, wherein the first module is a building block module comprising a first building block and a second building block which are snap fastened to form a building block stack, wherein the building block stack is mechanically retained by the second module upon snap fastening of the first building block and the second building block in a connection direction defined by a connection axis which is coaxial with the rotation axis, wherein a gap is present between the building block stack and the second module to facilitate relative rotation between the first module and the second module about the rotation axis;

wherein the first module comprises a first retention portion having a first retention profile extending in a radial direction with respect to the rotation axis and the second module comprises a second retention portion having a second retention profile extending in the radial direction, and wherein the first retention portion and the second retention portion cooperate to form a retention means to contain relative axial movement between the first module and the second module in the axial direction within a tight tolerance while permitting relative rotation between the first module and the second module about the rotation axis;

wherein the first retention portion comprises a first partial retention portion on the first building block and a second partial retention portion on the second building block, and wherein the first partial retention portion and the second partial retention portion are stacked in a stacking direction along a stacking axis to form the first retention portion, the stacking axis being aligned with the rotation axis; and wherein the first retention portion of the first module comprises a peripherally extending channel, wherein the second retention portion of the second module comprises a peripherally extending rib, and wherein the peripherally extending channel forms a bearing race along which the peripherally extending rib is to slide to facilitate relative rotation between the first module and the second module.

* * * * *